US012778323B2

(12) United States Patent
Rauch et al.

(10) Patent No.: US 12,778,323 B2
(45) Date of Patent: Nov. 3, 2026

(54) CLOTHING AND FASHION ACCESSORIES FOR PLANTS

(71) Applicants: Lillian C. Rauch, Lake Barrington, IL (US); Melanie I. Rauch, Lake Barrington, IL (US)

(72) Inventors: Lillian C. Rauch, Lake Barrington, IL (US); Melanie I. Rauch, Lake Barrington, IL (US)

( * ) Notice: Subject to any disclaimer, the term of this patent is extended or adjusted under 35 U.S.C. 154(b) by 22 days.

(21) Appl. No.: 18/652,783

(22) Filed: May 1, 2024

(65) Prior Publication Data

US 2024/0277164 A1 Aug. 22, 2024

Related U.S. Application Data

(63) Continuation-in-part of application No. 17/183,308, filed on Feb. 23, 2021, now abandoned.

(60) Provisional application No. 62/981,021, filed on Feb. 24, 2020.

(51) Int. Cl.
*A47G 7/08* (2006.01)

(52) U.S. Cl.
CPC ..... *A47G 7/08* (2013.01)

(58) Field of Classification Search
CPC ... A47G 7/08; A47G 7/02; A47G 7/00; A47G 5/04; A47G 7/04; B44C 5/06; A01G 9/02
USPC ..... 47/72, 66.6
See application file for complete search history.

(56) References Cited

U.S. PATENT DOCUMENTS

| | | | | | |
|---|---|---|---|---|---|
| 1,695,350 | A * | 12/1928 | Shively | A44C 19/00 | 150/134 |
| 3,153,301 | A * | 10/1964 | Redyke | A47G 7/08 | 47/33 |
| 4,914,860 | A * | 4/1990 | Richardson | A47G 7/08 | 47/72 |
| 5,003,725 | A * | 4/1991 | Maddox | A01G 5/04 | 248/312.1 |
| 5,735,075 | A * | 4/1998 | Honkawa | A01G 5/04 | 47/41.12 |
| 6,038,812 | A * | 3/2000 | Belokin | A01G 5/04 | 40/430 |
| 6,085,461 | A * | 7/2000 | Brisson | A47G 7/02 | 47/78 |
| 7,108,391 | B2 * | 9/2006 | Chuang | A41G 1/005 | 362/555 |
| 7,351,128 | B1 * | 4/2008 | Burns | A63H 3/02 | 446/369 |
| 8,052,534 | B2 * | 11/2011 | Crouch | A63F 13/00 | 463/47 |
| 2003/0228825 | A1 * | 12/2003 | Whitehead | A63H 33/26 | 446/129 |
| 2005/0022286 | A1 * | 2/2005 | Noble | A41D 27/08 | 2/69 |

(Continued)

FOREIGN PATENT DOCUMENTS

| | | | | |
|---|---|---|---|---|
| CA | 2238564 A1 * | 5/1999 | A47G 29/00 | |
| CN | 202826927 U * | 3/2013 | B44C 5/00 | |

(Continued)

*Primary Examiner* — Carly W. Lynch

(57) ABSTRACT

An article of clothing for a plant and a planter. The article includes a first wearable article that is configured to be worn by the plant and a second wearable article that is configured to be fitted to a least a portion of a planter in which the plant is planted.

15 Claims, 24 Drawing Sheets

(56) References Cited

U.S. PATENT DOCUMENTS

| | | | | |
|---|---|---|---|---|
| 2006/0026895 | A1* | 2/2006 | Pravettoni | A47G 7/07 47/39 |
| 2007/0028519 | A1* | 2/2007 | Seibel | A47G 7/047 47/72 |
| 2012/0047630 | A1* | 3/2012 | Gare | A41D 27/08 2/244 |
| 2012/0142249 | A1* | 6/2012 | Chan | A63H 3/12 446/321 |
| 2012/0214013 | A1* | 8/2012 | Namsaraeva | H01F 7/0263 24/442 |
| 2013/0052912 | A1* | 2/2013 | Pampliega | A63H 3/16 446/376 |
| 2017/0006945 | A1* | 1/2017 | Powers | A41D 27/08 |
| 2020/0323298 | A1* | 10/2020 | Morgan | A41F 7/00 |
| 2021/0196060 | A1* | 7/2021 | Lawson | A63H 3/02 |

FOREIGN PATENT DOCUMENTS

| | | | | | |
|---|---|---|---|---|---|
| CN | 103299854 | A | * | 9/2013 | A01G 9/10 |
| CN | 104188140 | A | * | 12/2014 | A41B 1/00 |
| DE | 20219329 | U1 | * | 3/2003 | A01G 5/04 |
| GB | 2093408 | A | * | 9/1982 | A01G 9/02 |
| JP | 2005040049 | A | * | 2/2005 | A01G 1/00 |
| JP | 2006001210 | A | * | 1/2006 | B44C 5/06 |
| JP | 2013240971 | A | * | 12/2013 | A01N 3/00 |
| JP | 3209059 | U | * | 3/2017 | A47G 7/08 |

* cited by examiner

CLOTHING AND FASHION ACCESSORIES FOR PLANTS

FIELD OF THE INVENTION

The invention relates to clothing and fashion accessories adapted for wear by plants and planters.

BACKGROUND OF THE INVENTION

Plants are living things. Houseplants add an element of beauty to the décor in many homes and offices. Just as pets are often treated as full-fledged members of a family, so too are many houseplants. People feed their houseplants, talk to their houseplants, and give their houseplants names. Some people even use the services of a plant hotel to care for their plants when the owners are on vacation.

As the popularity of houseplants continues to grow, the houseplant industry is creating off-shoots, with a variety of online plant delivery services and in-home or in-office plant care. As people invest more time and energy in their houseplants, there is a need or desire to find ways to personalize, and perhaps to personify, houseplants.

SUMMARY OF THE INVENTION

The object of the invention, therefore, is to provide clothing and accessories configured to be worn by plants and/or planters. Unlike clothing for human beings, the clothing is specially configured to either fit on or around a portion of a plant, or to at least a portion of a planter in which the plant is situated. Certain outfits may include clothing and/or fashion accessories that adorn both the plant and the planter.

According to certain embodiments, an outfit for a plant and a planter includes a first wearable article that is configured to be worn by the plant, and a second wearable article that is configured to be fitted to at least a portion of a planter in which the plant is planted.

The first wearable article may be an article of clothing or a fashion accessory. For example, the first wearable article may be any of the following: a shirt, a dress, a sweater, a jacket, swimwear, sleepwear, a bib, a cape, a scarf, a stole, a necklace, a uniform, a costume, a hat, a tiara, earmuffs, suspenders, a necklace, earrings, a bowtie, a necktie, eyeglasses, sunglasses, mittens, gloves, a handbag, a backpack, a briefcase, a tote bag, a fanny pack, a belt, a holiday decoration, a musical instrument, an umbrella, a tool, facial hair, a wig, an electronic device, a dining utensil, a pacifier, sporting equipment, a stuffed animal, a faux food item, and faux animal body parts.

Similarly, the second wearable article may be an article of clothing or a fashion accessory. For example, the second wearable article may be any of the following: pants, a belt, shorts, a dress, a skirt, a shirt, a sweater, a jacket, swimwear, sleepwear, a diaper, a cape, a scarf, a stole, a uniform, a costume, an apron, a dress, a bib, a necklace, a hat, a tiara, earmuffs, suspenders, a bowtie, a necktie, eyeglasses, sunglasses, mittens, gloves, a handbag, a backpack, a briefcase, a tote bag, a fanny pack, a holiday decoration, a musical instrument, a tool, at least one shoe, at least one sock, facial hair, a wig, sporting equipment, a faux food item, and faux animal body parts.

According to certain embodiments, the first wearable article and the second wearable article may be connected to one another, either refastenably or permanently.

The first wearable article may be configured to be attached to one or more branches, stems, or leaves of the plant with at least one connector. The connector may include one or more of the following: bendable wires, flexible supports, rigid supports, ribbon, string, elasticized material, hook and loop fasteners, snaps, buttons, a zipper, a silicone surface, an adhesive-covered surface, a surface having enhanced friction, and magnets. Alternatively, the first wearable article may be attached to a first end of a support while the second end of the support is configured for insertion into the soil or other medium in the planter in which the roots of the plant are situated. As another alternative, the first wearable article may be attached to a first end of a support while the second end of the support is configured for attachment to the planter.

The second wearable article may be configured to be fitted to at least a portion of the planter with at least one connector. The connector may include one or more of the following: elasticized material, hooks, hook and loop fasteners, snaps, buttons, bendable wires, flexible supports, rigid supports, ribbon, string, a zipper, an adjustable strap, a buckle, a slider and ring, and magnets.

According to certain embodiments, either the first wearable article or the second wearable article, or both the first and second wearable articles, may include a refastenable attachment element for attaching at least one fashion accessory to the respective wearable article. The fashion accessory may include one or more of the following: a necklace, earrings, a bowtie, a necktie, eyeglasses, sunglasses, a hat, a bib, a cape, a scarf, a stole, mittens, gloves, a handbag, a backpack, a briefcase, a tote bag, a fanny pack, a belt, a holiday decoration, a musical instrument, an umbrella, a tool, facial hair, a wig, an electronic device, a dining utensil, sporting equipment, a stuffed animal, a faux food item, and faux animal body parts. The fashion accessory may include a storage space.

According to certain embodiments, the outfit may include an additional first wearable article that has the same visual appearance as the first wearable article, with the additional first wearable article configured to be worn by a human or by a pet. Likewise, the outfit may include an additional second wearable article that has the same visual appearance as the second wearable article, with the additional second wearable article configured to be worn by a human or by a pet. Similarly, the outfit may include an additional fashion accessory that has the same visual appearance as the fashion accessory, with the additional fashion accessory configured to be worn by a human or by a pet.

DETAILED DESCRIPTION OF THE PREFERRED EMBODIMENTS

Figure 1:
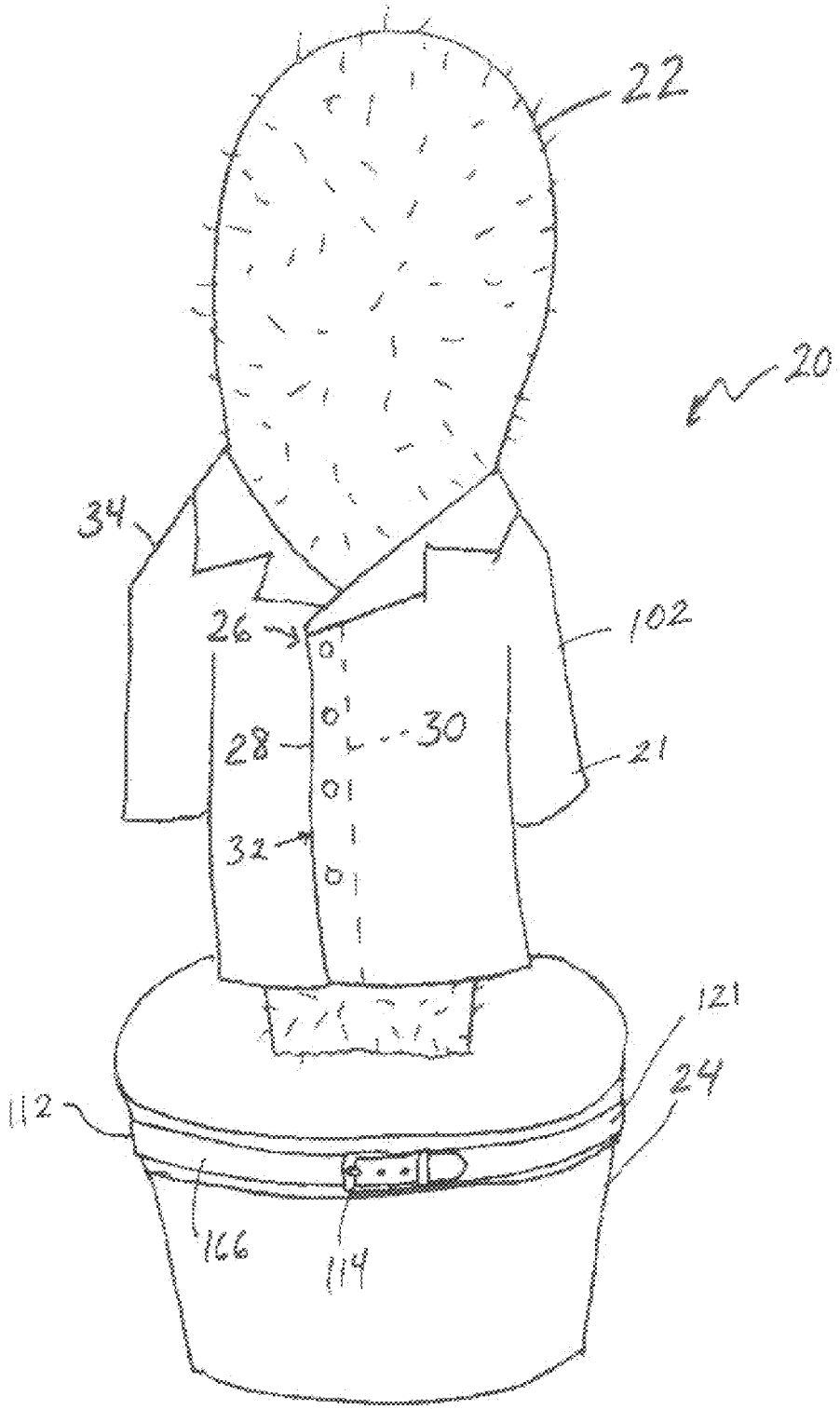
FIG. 1 is a front perspective view of one embodiment of an outfit in the form of a shirt adorning a plant and a belt adorning a planter.

Clothing and accessories can be configured specifically for plants and/or planters. In contrast to clothing worn by human beings, or even clothing worn by pets or dolls, clothing and accessories configured to be worn by plants are designed to be put on the plant without harming any of the plant's leaves, branches, or stems, and are also designed to be worn without adversely affecting the growth and health of the plant. Furthermore, the clothing and accessories may include an adjustable fastening system to provide an optimum fit in terms of minimizing or avoiding damage to the plant and in terms of providing a well-fitting, dapper appearance.

An outfit 20 for a plant 22 and a planter 24 suitably includes a first wearable article 102 that is configured to be worn by the plant 22 and a second wearable article 112 that is configured to be fitted to a least a portion of a planter 24 in which the plant 22 is planted. As used herein, the term "worn," with respect to a plant, refers to an article being in close enough proximity to the plant to touch the plant without necessarily applying any pressure to the plant.

The first wearable article 102 may be an article of clothing 21 or a fashion accessory 121. For example, the first wearable article 102 may be any of the following: a shirt, a dress, a sweater, a jacket, swimwear, sleepwear, a bib, a cape, a scarf, a stole, a necklace, a uniform, a costume, a hat, a tiara, earmuffs, suspenders, a necklace, earrings, a bowtie, a necktie, eyeglasses, sunglasses, mittens, gloves, a handbag, a backpack, a briefcase, a tote bag, a fanny pack, a belt, a holiday decoration, a musical instrument, an umbrella, a tool, facial hair, a wig, an electronic device, a dining utensil, a pacifier, sporting equipment, a stuffed animal, a faux food item, and faux animal body parts.

Similarly, the second wearable article 112 may be an article of clothing 21 or a fashion accessory 121. For example, the second wearable article 112 may be any of the following: pants, a belt, shorts, a dress, a skirt, a shirt, a sweater, a jacket, swimwear, sleepwear, a diaper, a cape, a scarf, a stole, a uniform, a costume, an apron, a dress, a bib, a necklace, a hat, a tiara, earmuffs, suspenders, a bowtie, a necktie, eyeglasses, sunglasses, mittens, gloves, a handbag, a backpack, a briefcase, a tote bag, a fanny pack, a holiday decoration, a musical instrument, a tool, at least one shoe, at least one sock, facial hair, a wig, sporting equipment, a faux food item, and faux animal body parts.

The first wearable article 102 may be configured to be attached to one or more branches, stems, or leaves of the plant 22 with at least one connector 104. The connector 104 may include one or more of the following: bendable wires, flexible supports, rigid supports, ribbon, string, elasticized material, hook and loop fasteners, snaps, buttons, a zipper, a silicone surface, an adhesive-covered surface, a surface having enhanced friction, and magnets. Alternatively, the first wearable article 102 may be attached to a first end of a support 122 while the second end of the support 122 is configured for insertion into the soil or other medium 25 in the planter 24 in which the roots of the plant 22 are situated. As another alternative, the first wearable article 102 may be attached to a first end of a support 122 while the second end of the support 122 is configured for attachment to the planter 24.

The supports 122 may be made of plastic, wood, metal, fabric, or any other suitable material. For example, the supports 122 may be between about 1 cm and about 1 meter long, or between about 5 cm and about 50 cm, or between about 5 cm and about 25 cm long. The supports 122 may be stick-like supports 123, such as in the form of a chopstick, baton, or sewing needle, for example. Alternatively, the support or supports 122 may be in the form of a clip support 124, such as in the form of a hairpin, barrette, or other clip. Such clips 124 may have extra lining, for example a felt or other soft lining, to protect the leaves of the plant 22 from any damaging force. Examples of other suitable lining materials include cotton, velvet, suede, and any other fluffy or puffy materials. The first wearable article 102 may also include one or more elasticized elements and/or adjustable straps, as described herein.

The second wearable article 112 may be configured to be fitted to at least a portion of the planter 24 with at least one connector 114. The connector 114 may include one or more of the following: elasticized material, hooks, hook and loop fasteners, snaps, buttons, bendable wires, flexible supports, rigid supports, ribbon, string, a zipper, an adjustable strap, a buckle, a slider and ring, and magnets.

For example, the article of clothing 21 may include an opening 26 that extends at least a partial length, or a full length, of the article of clothing 21 between a first longitudinal edge 28 and a second longitudinal edge 30 of the article of clothing 21. As used herein, the term "longitudinal edge" refers to an edge that extends a length of an article of clothing 21 between two other edges, such as between a top edge and a bottom edge. The longitudinal edge is not limited to an edge that is parallel to a vertical axis. Furthermore, the longitudinal edges encompass a width greater than the very edge of the article of clothing 21. More particularly, the longitudinal edges include a region that may extend from the very edge of the article of clothing 21 to 10 cm from the edge of the article of clothing 21, or from the very edge of the article of clothing 21 to 5 cm from the edge of the article of clothing 21, or from the very edge of the article of clothing 21 to 2 cm from the edge of the article of clothing 21, depending on the size and style of the article of clothing 21.

Likewise, the fashion accessory 121 may be applied to the plant 22 or planter 24 in any of the same manners as described above with respect to the article of clothing 21. More particularly, the fashion accessory 121 may include an opening 126 that extends at least a partial length of the fashion accessory 121 between a first longitudinal edge 128 and a second longitudinal edge 130 of the fashion accessory 121, and the fashion accessory 121 may include a refastenable seam 132 that refastenably connects at least a portion of the first longitudinal edge 128 to at least a portion of the second longitudinal edge 130.

According to certain embodiments, the second wearable article 112 may cover at least a portion of a bottom surface of the planter 24, thereby providing an additional benefit of serving as a coaster on the surface upon which the planter 24 rests.

Figure 2:
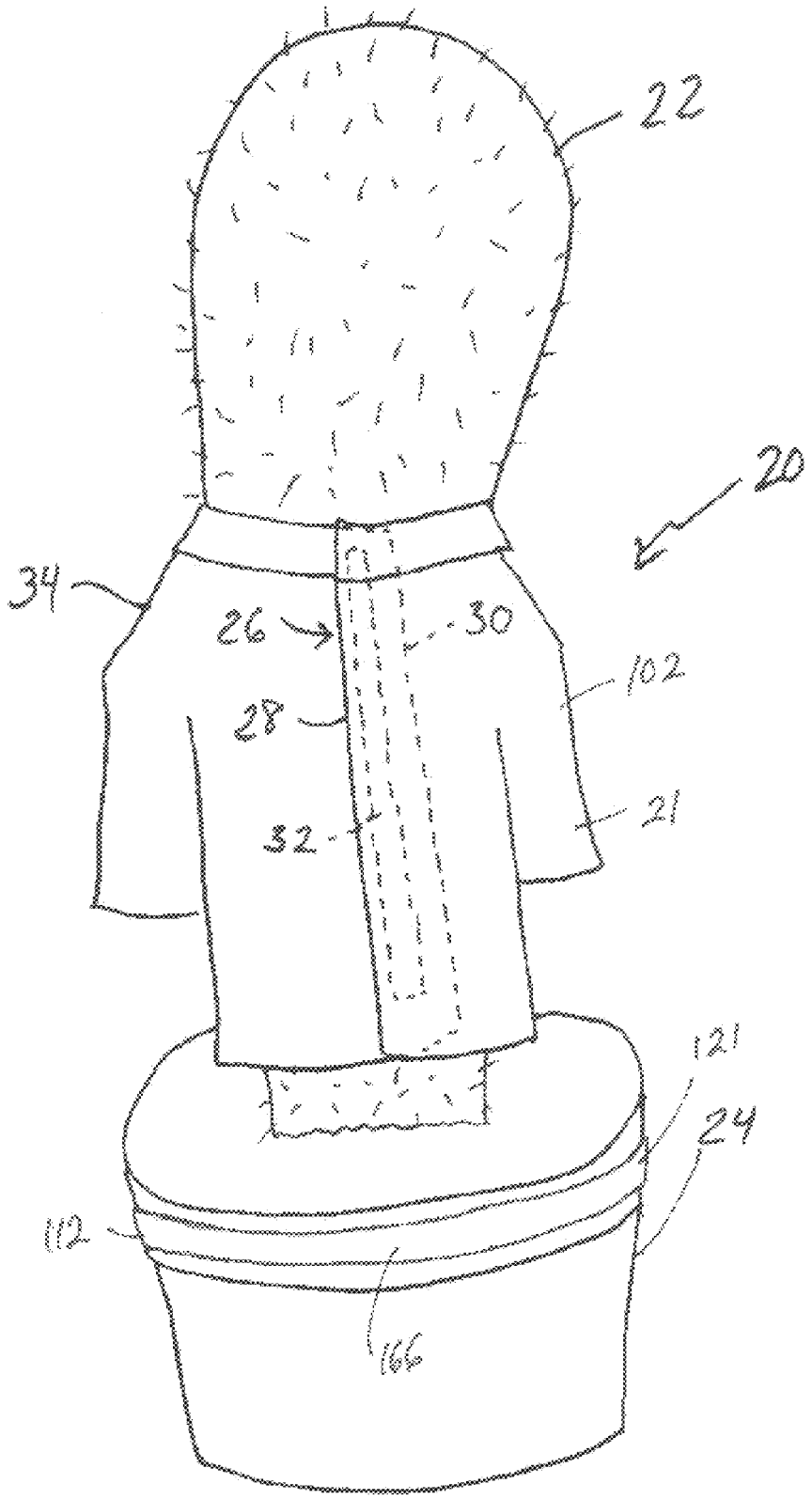
FIG. 2 is a rear perspective view of the outfit in FIG. 1.

FIG. 1 shows an embodiment of the outfit 20 with the first wearable article 102 in the form of a shirt 34 and the second wearable article 112 in the form of a belt 166. The shirt 34 may include a refastenable seam 32 in the front, just like shirts worn by people. Alternatively, the front seam may be a faux seam that is not refastenable, and the refastenable seam 32 may be located in the back, as shown in FIG. 2. Thus, the shirt 34 may have a refastenable seam 32 in the front, the back, and/or on one or more sides of the shirt 34. In the embodiment shown in FIG. 2, the refastenable seam 32 is in the back of the shirt 34 to provide for ease of applying the outfit 20 to the plant 22 or planter 24, and to provide an adjustable fit on the plant 22 or planter 24. The refastenable seam 32 may extend a full length of the shirt 34, or the seam 32 may be sewn or otherwise permanently attached along a lower portion of the seam 32 with an upper portion of the seam being refastenable, or the seam 32 may be sewn or otherwise permanently attached along the upper portion of the seam 32 with the lower portion being refastenable. The belt 166 may be made of leather, vinyl, woven material, or any other suitable material. The belt 166 may be fitted around a circumference of the planter 24 and fastened with a buckle in the manner of a conventional belt worn by humans. Additionally or alternatively, the belt 166 may be secured to the planter 24 with any of the other aforementioned connectors 114.

FIGS. 1 and 2 show the outfit 20 with the first wearable article 102 in the form of a shirt 34 in place on a plant 22 and with the second wearable article 112 in the form of a belt 166 in place on a planter 24. The shirt 34 can be applied to the plant 22 with the refastenable seam 32 in an open position. Once the shirt 34 is in place, the refastenable seam 32 is fastened, thereby connecting at least a portion of the first longitudinal edge 28 to at least a portion of the second longitudinal edge 30. Some leaves, branches, or other portions of the plant 22 may extend through the sleeves, with a main trunk or a stem of the plant 22 extending through a body portion of the shirt 34; or the shirt 34 may be applied to the main trunk or a stem of the plant 22 with no foliage or branches extending through the sleeves. Alternatively, the shirt 34 may be applied to one or more branches or leaves without surrounding the main trunk or stem of the plant, or other branches or leaves. For example, many plants have a plethora of stems rather than a single main trunk or stem. Such plants may wear the shirt 34 on one or more stems or branches.

Figure 3:
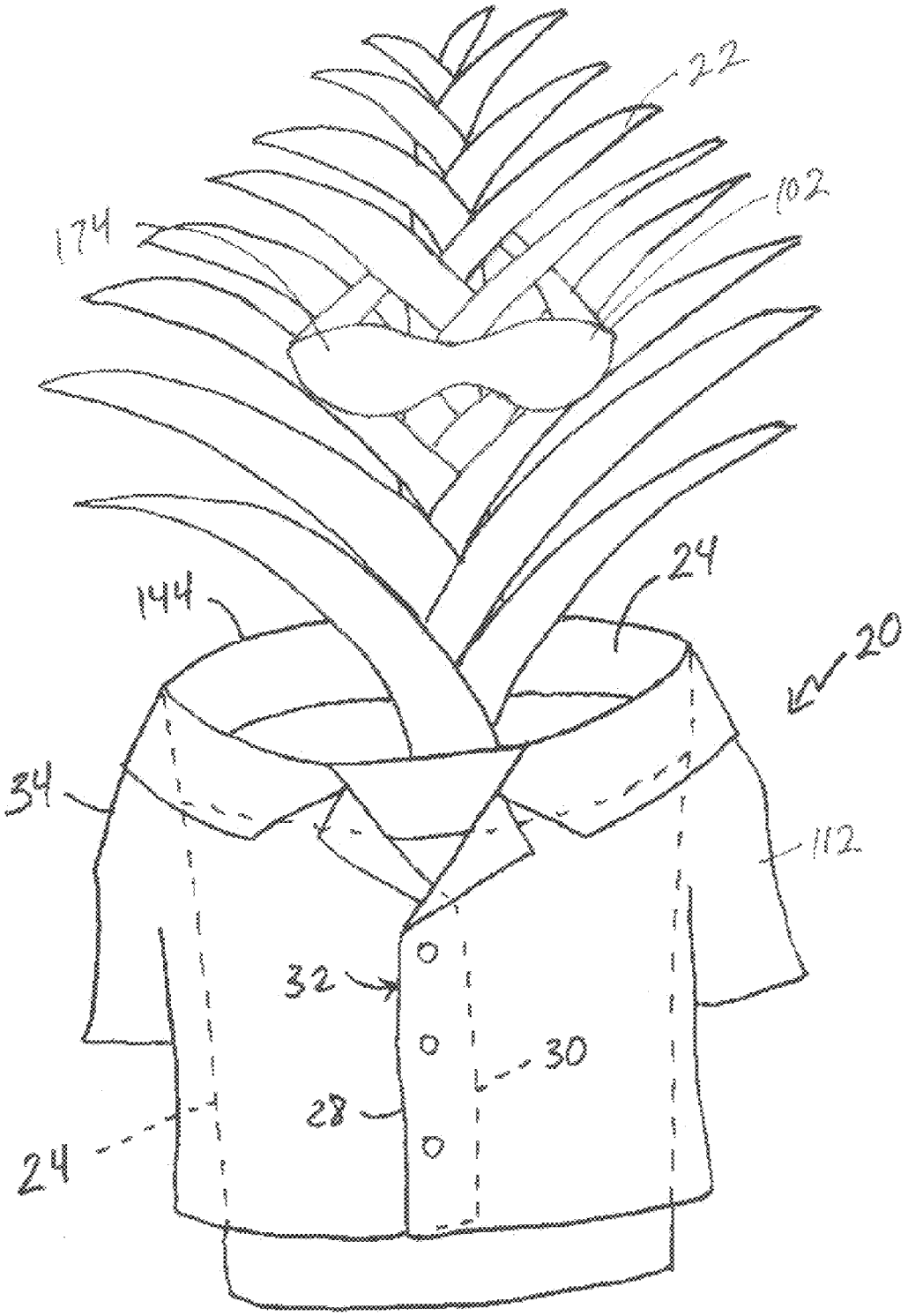
FIG. 3 is a front perspective view of another embodiment of an outfit in the form of sunglasses adorning a plant and a shirt adorning a planter.

FIG. 3 shows the outfit 20 with the first wearable article 102 in the form of sunglasses 174 worn by the plant 22 and the second wearable article 112 in the form of a shirt 34 in place on the planter 24. The sunglasses 174 may be fitted around a branch, stem, or leaves, of the plant 22 with the frame of the glasses, comparable to the manner in which humans wear sunglasses. Additionally or alternatively, the sunglasses 174 may be worn by the plant 22 using any of the aforementioned connectors 104. The shirt 34 may be applied to the planter 24 with the refastenable seam 32 in an open position, and the refastenable seam 32 can be fastened once the shirt 34 is in place, thereby connecting at least a portion of the first longitudinal edge 28 to at least a portion of the second longitudinal edge 30. The outfit 20 may be worn wholly below a top edge 144 of the planter 24, or a portion of the outfit 20 may extend over the top edge 144 of the planter 24.

Articles of clothing 21 and fashion accessories 121 designed to fit plants 22 will not necessarily fit planters 24, and articles of clothing 21 and fashion accessories 121 designed to fit planters 24 will not necessarily fit plants 22, but some articles of clothing 21 and some fashion accessories 121 may fit both plants 22 and planters 24.

As noted above, the first wearable article 102 or second wearable article 112 may be a shirt 34, such as a button-down shirt or a t-shirt, a tank top, a sweatshirt, a sweater, or any other type of top, as shown in FIGS. 1-3. The first wearable article 102 or second wearable article 112 may also be pants, such as jeans, khaki pants, overalls, sweatpants, shorts, a skirt, or any other type of bottoms.

Figure 4:
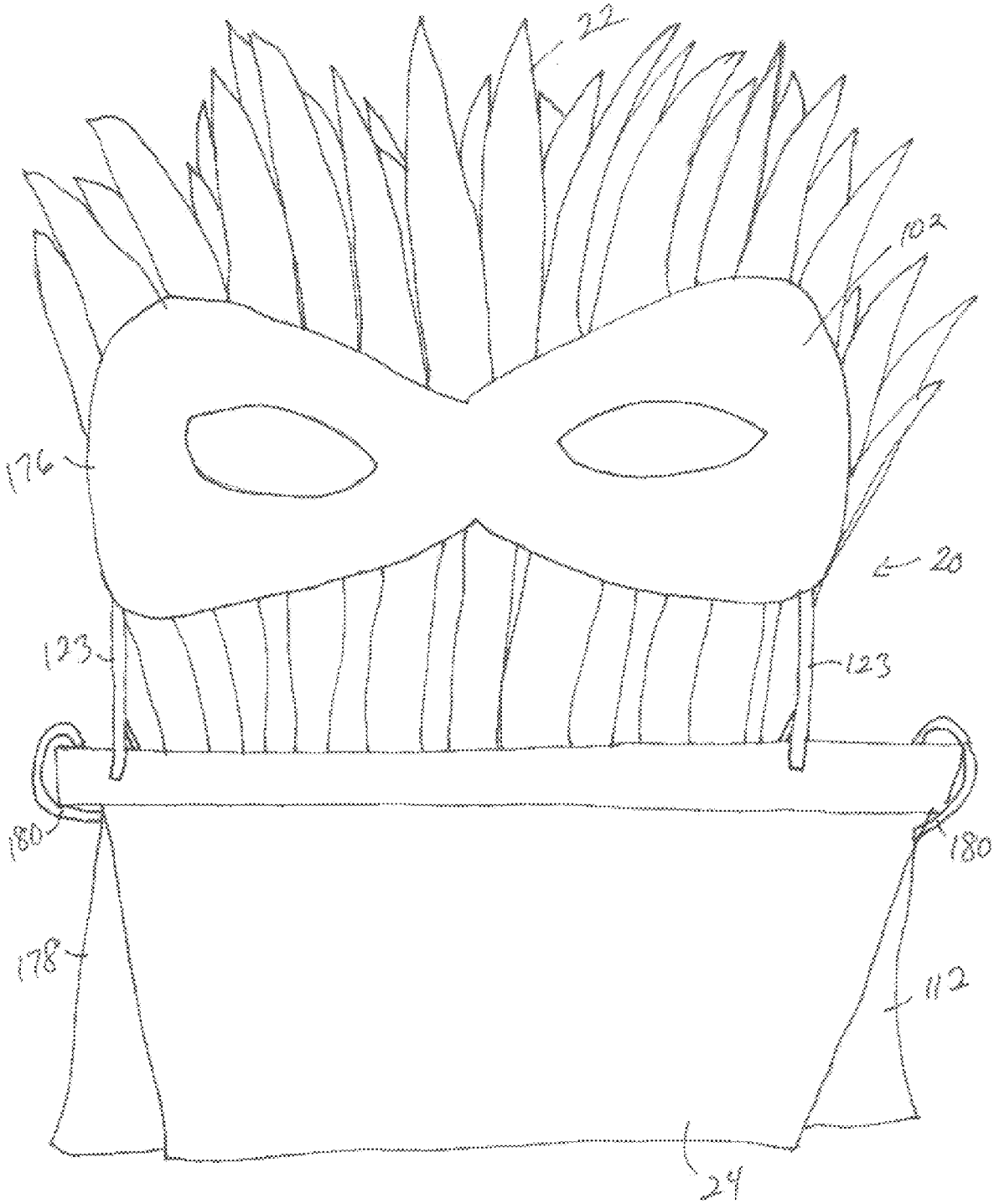
FIG. 4 is a front perspective view of yet another embodiment of an outfit in the form of a mask adorning a plant and a cape adorning a planter.

For special occasions, the outfit 20 may be a costume, such as a Halloween costume, for example, a witch, a ghost, a pirate, a pumpkin, a superhero, a pop culture character, an animal, and the like. The outfit 20 may also be a costume that includes ethnic dress garb, such as a French beret, a Viking horned helmet, a Scottish kilt, German lederhosen, a Hawaiian lei or a Hawaiian grass skirt. FIG. 4 shows the outfit 20 in the form of a costume, with the first wearable article 102 in the form of a mask 176 in place on a plant 22 and with the second wearable article 112 in the form of a cape 178 in place on a planter 24. The mask 176 is attached to a first end of two rigid supports 123 while a second end of each of the supports 123 is attached to the planter 24. The rigid supports 123 each have a clip at the second end that secures the supports 123 to the planter 24. Other suitable configurations for securing the supports 123 to the planter 24 include hook and loop fasteners and other mechanical connections, as well as adhesives, and magnets. The cape 178 is secured to the planter 24 with hooks 180, which may be made of metal, plastic, or other suitable materials. One end of each hook 180 may be sewed, glued, or otherwise secured to the cape 178 while the opposite end of each hook 180 hooks onto the planter 24.

Figure 5:
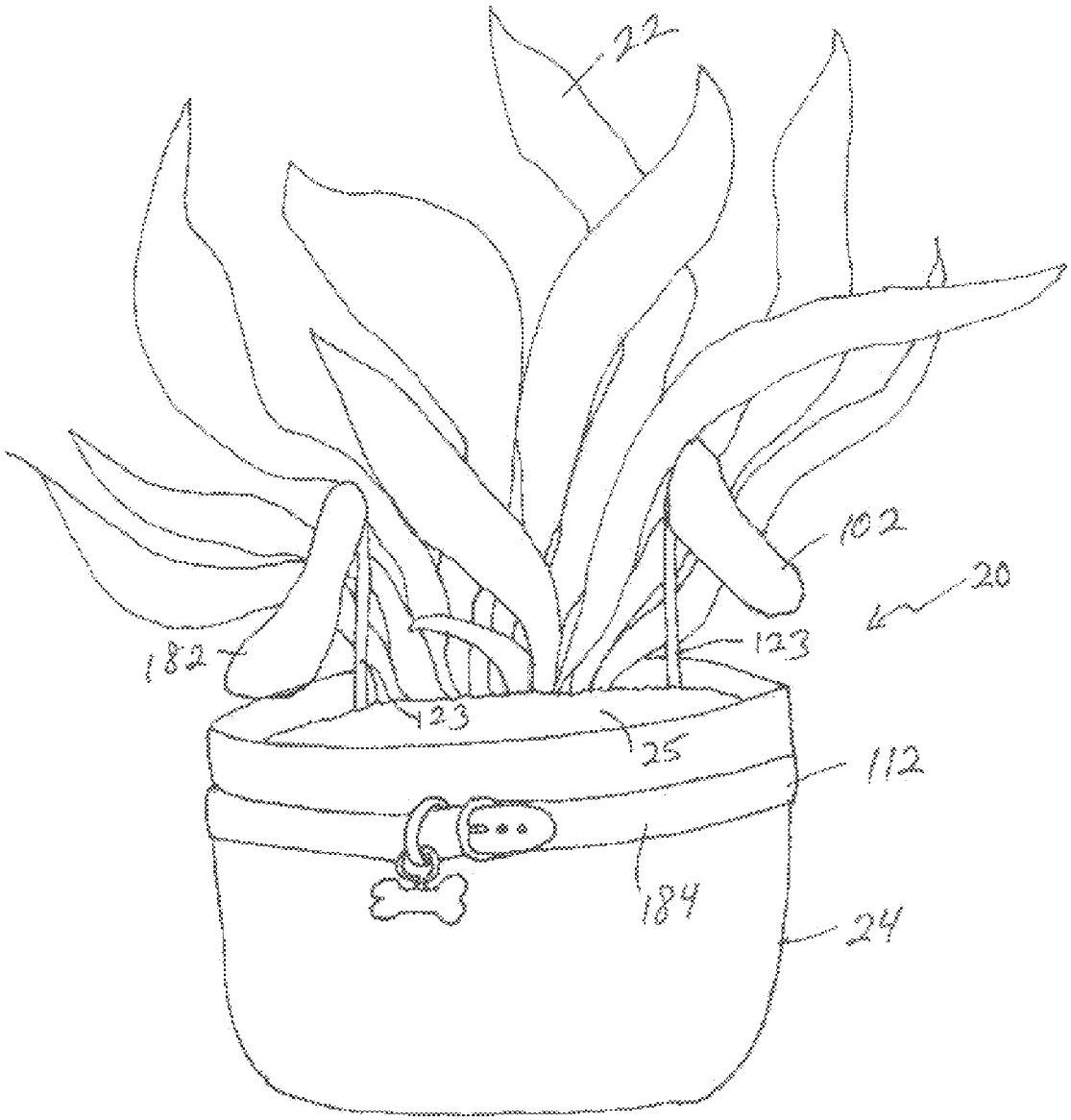
FIG. 5 is a front perspective view of another embodiment of an outfit in the form of a pair of faux dog ears adorning a plant and a dog collar adorning a planter.

The outfit 20 may include a stuffed animal or a faux animal body part, such as an animal tail, wings, a snout, animal ears, animal horn, or an animal trunk. FIG. 5 shows the outfit 20 with the first wearable article 102 in the form of a pair of dog ears 182 worn by a plant 22 and with the second wearable article 112 in the form of a dog collar 184 in place on a planter 24. The dog ears 182 may be made of faux fur or other suitable fabric. The dog ears 182 are each attached to a first end of a rigid support 123 while a second end of each of the supports 123 is inserted into the soil or other medium 25 in the planter 24 in which the roots of the plant 22 are situated. The dog collar 184 is fitted around a circumference of the planter 24 and fastened with a buckle in the manner of a conventional dog collar. Additionally or alternatively, the dog collar 184 may be secured to the planter 24 with any of the other aforementioned connectors 114.

Figure 6:
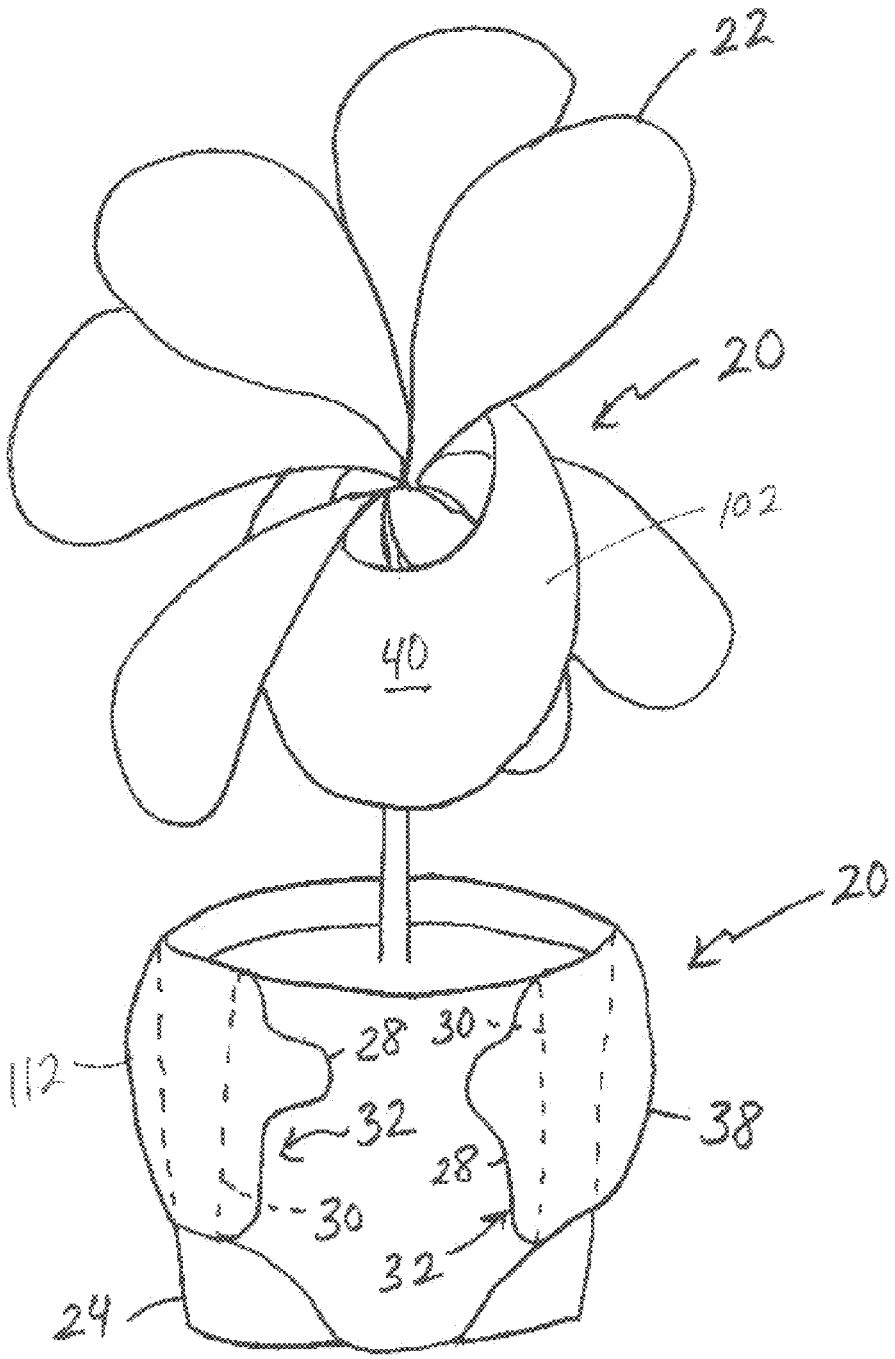
FIG. 6 is a front perspective view of still another embodiment of an outfit in the form of a diaper and a bib adorning a planter and a plant.

As another example, the outfit 20 may include the second wearable article 112 in the form of a diaper 38, either a cloth diaper or a disposable diaper, and the first wearable article 102 in the form of a bib 40. FIG. 6 shows a bib 40 adorning a plant 22, and a diaper 38 adorning a planter 24. The bib 40 has a refastenable seam 32 extending along a length of the bib 40 between a first longitudinal edge and a second longitudinal edge of the bib 40 in the back of the bib 40 (not shown). The diaper 38 has two refastenable seams 32 extending along a length of the diaper 38 between a first longitudinal edge 28 and a second longitudinal edge 30 of the diaper 38 along opposite sides of the diaper 38. Alternatively, the two longitudinal seams shown in FIG. 6 may be faux seams, while the refastenable seam 32 may be provided in the back of the diaper 38, similar to the refastenable seam 32 on the back of the shirt 34 in FIG. 2. In the embodiments shown in FIG. 6, the diaper 38 extends fully below the planter 24, such that a bottom surface of the planter 24 rests on the diaper 38, thereby providing an additional benefit of serving as a coaster on the surface upon which the planter 24 rests, and potentially protecting the surface from water damage. Additionally or alternatively, the bib 40 and diaper 38 may be secured to the plant 22 and planter 24 with any of the other aforementioned connectors 114.

Figure 7:
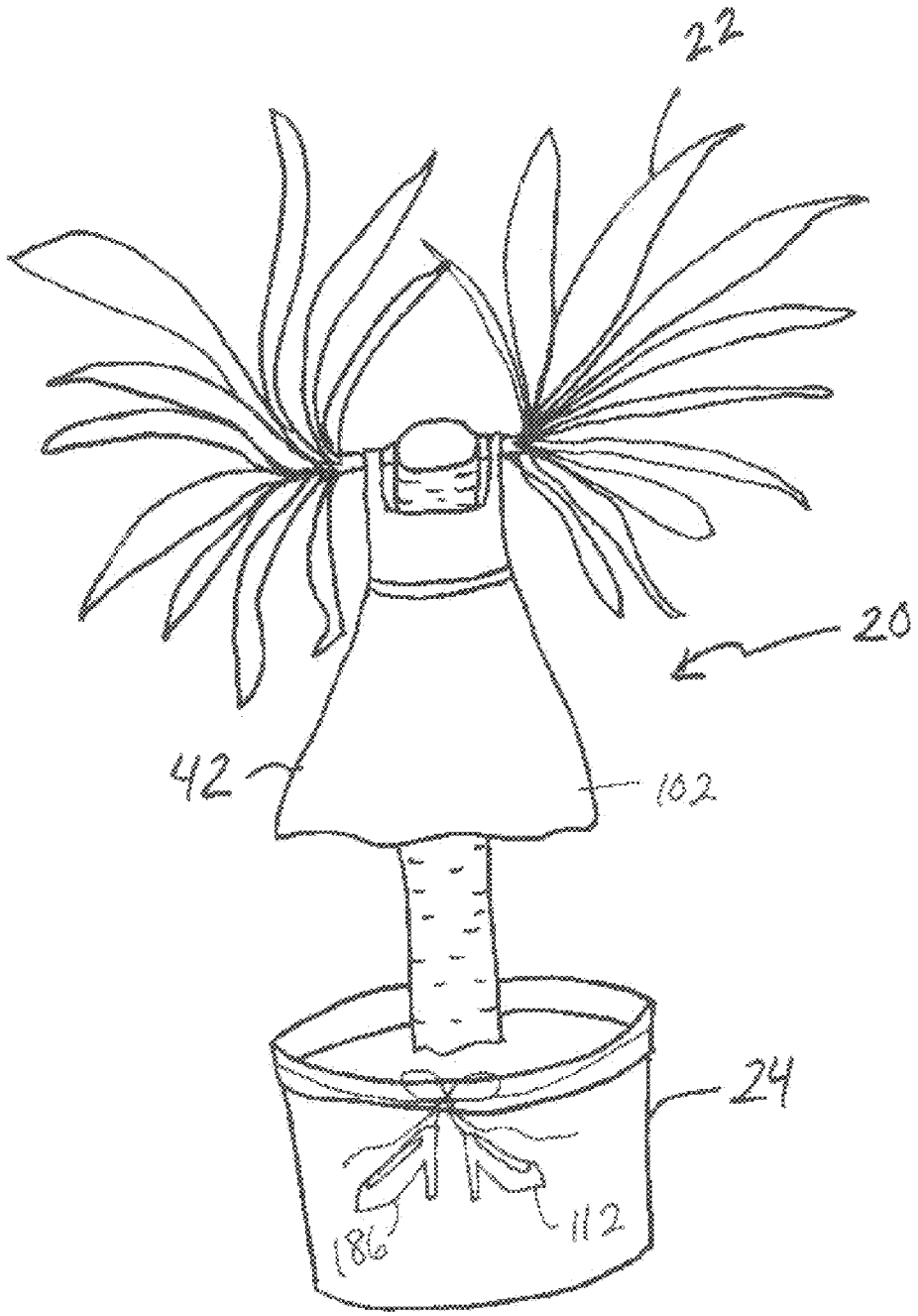
FIG. 7 is a front perspective view of another embodiment of an outfit in the form of a dress adorning a plant and a pair of shoes adorning a planter.
Figure 8:
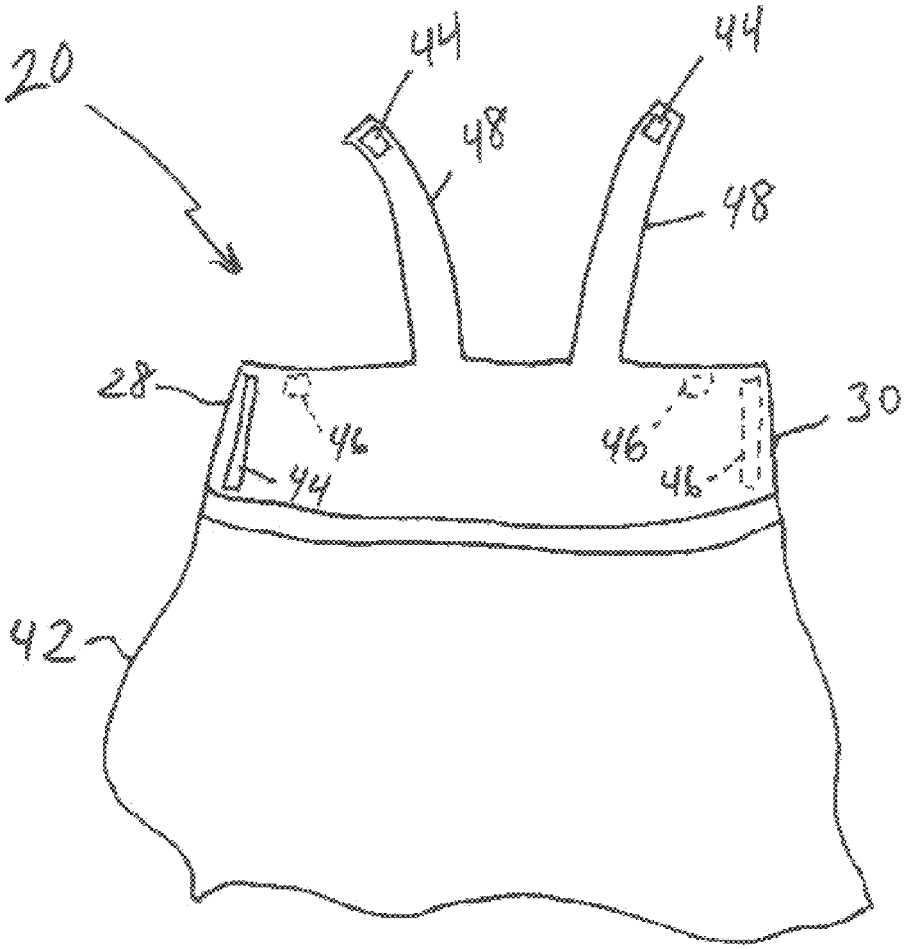
FIG. 8 is a plan view of the dress in FIG. 7.

The outfit 20 may also include a dress of any type, ranging from a simple sundress to an evening gown or princess gown, and any sort of dress in between. FIG. 7 shows the first wearable article 102 in the form of a dress 42 adorning a plant 22 and the second wearable article 112 in the form of a pair of shoes 186 tied to the planter 24. FIG. 8 shows the dress 42 in FIG. 7 in an unfastened state, with a first longitudinal edge 28 having a refastenable fastener 44 that can be attached to a corresponding fastener 46 on a second longitudinal edge 30 of the dress 42. In this embodiment, one end of each strap 48 of the dress 42 is also refastenable, enabling the straps 48 to be wrapped around branches or stems. Alternatively, each strap 48 may have a refastenable fastener 44 on each end of the strap, such that the straps 48 may be removed entirely to achieve a strapless embodiment of the dress 42. The shoes 186 may be tied around the circumference of the planter 24 with ribbon or string. Additionally or alternatively, the shoes 186 may be secured to the planter 24 with any of the other aforementioned connectors 114.

Figure 9:
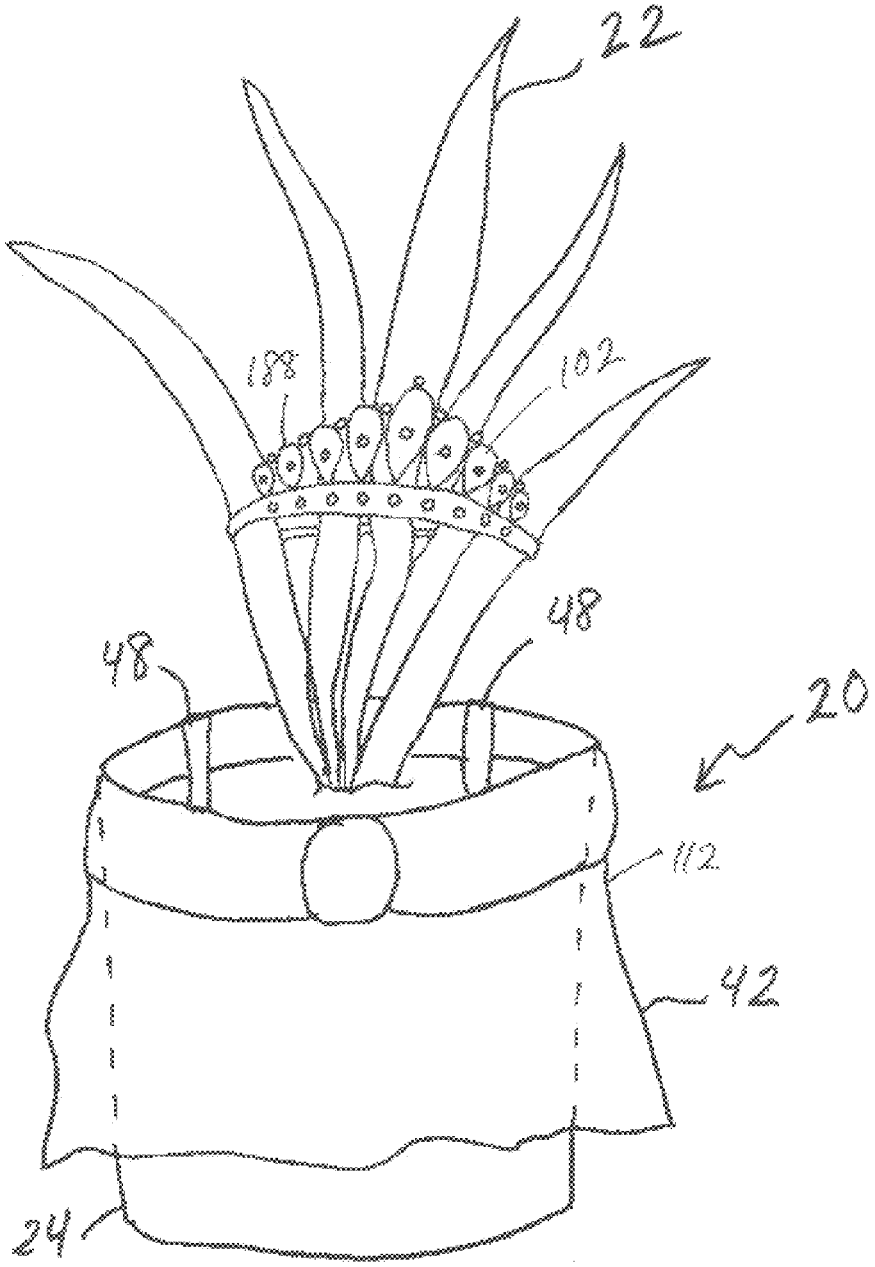
FIG. 9 is a front perspective view of another embodiment of an outfit in the form of a tiara adorning a plant and a dress adorning a planter.

FIG. 9 shows the first wearable article 102 in the form of a tiara 188 adorning a plant 22 and the second wearable article 112 in the form of a dress 42 adorning a planter 44. The tiara 188 may have an elastic strap across the back as shown in FIG. 9. Alternatively, the tiara 188 may be secured to the plant 22 with any of the other aforementioned connectors 114. Just like the embodiment shown in FIGS. 7 and 8, the dress 42 in FIG. 9 may have a first longitudinal edge 28 having a refastenable fastener 44 that can be attached to a corresponding fastener 46 on a second longitudinal edge 30 in the back of the dress 42. The straps 48 may be permanently attached to the dress 42, or may be refastenable on one or both ends. Additionally or alternatively, the straps 48 may be elasticized. Furthermore, the inclusion of straps 48 is optional.

Figure 10:
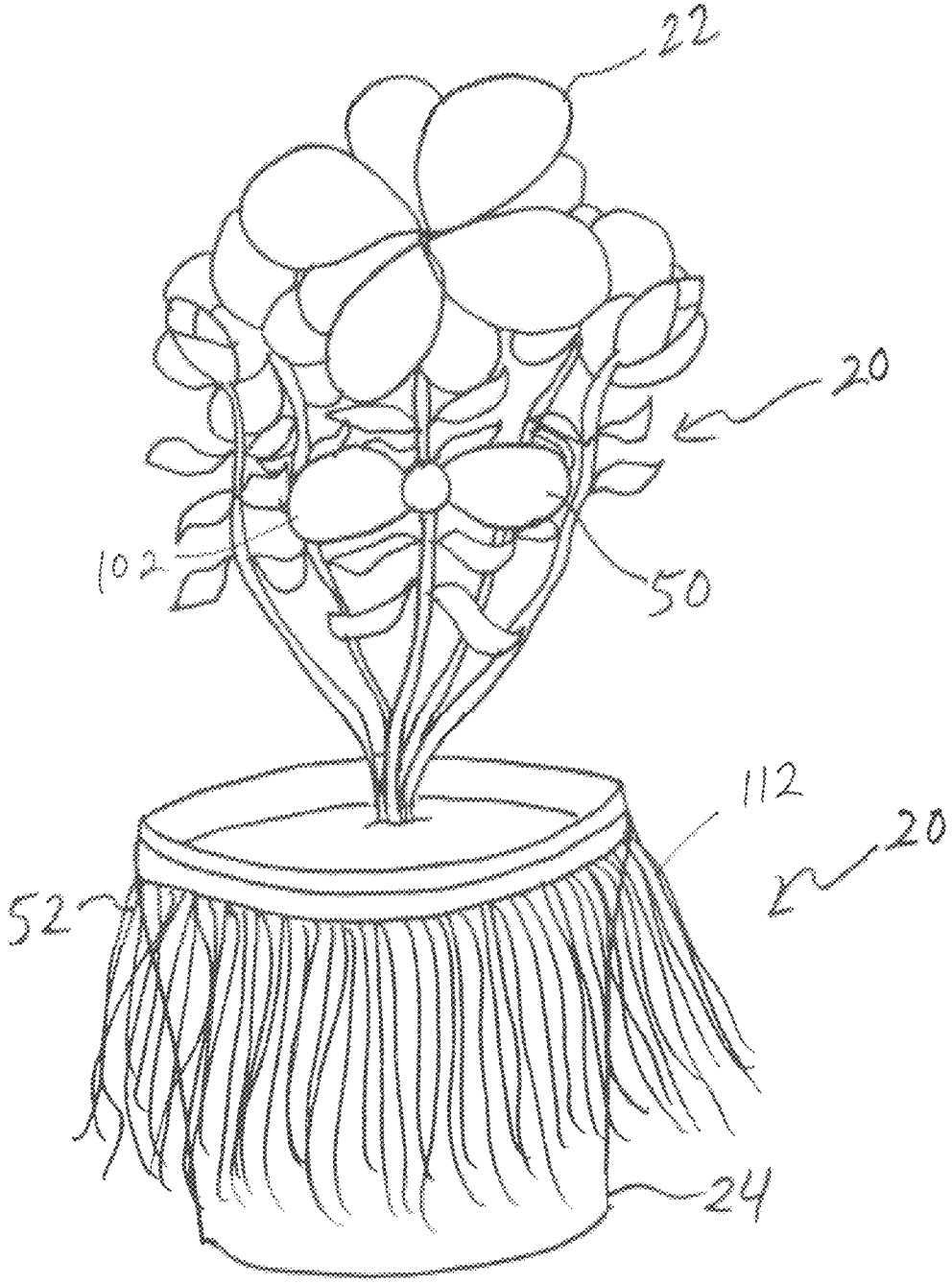
FIG. 10 is a front perspective view of still another embodiment of an outfit in the form of a bikini top and a grass skirt adorning a plant and a planter.
Figure 11:
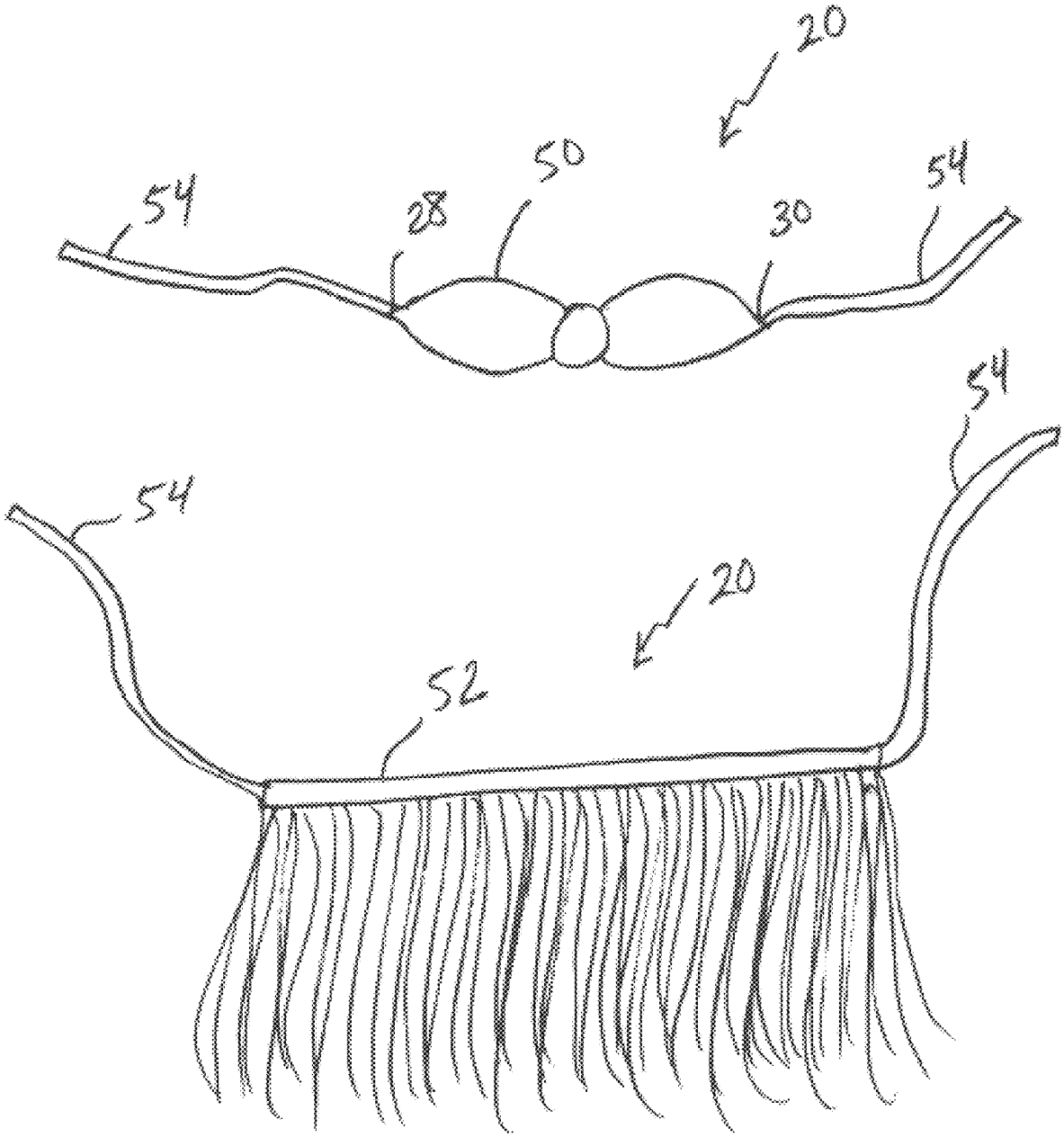
FIG. 11 is a plan view of the outfit in FIG. 10.

In certain embodiments, the outfit 20 may include swimwear and/or swim accessories, such as a swimsuit, a bikini, snorkel gear, or a beach cover-up. For example, FIG. 10 shows the first wearable article 102 in the form of a bikini top 50 adorning a plant 22, and the second wearable article 112 in the form of a grass skirt 52 adorning a planter 24. The bikini top 50 includes an opening that extends at least a partial length of the garment between a first longitudinal edge 28 and a second longitudinal edge 30 of the garment in the back of the bikini top 50. FIG. 11 shows the bikini top 50 in FIG. 10 in an unfastened state. The first longitudinal edge 28 and the second longitudinal edge 30 can be refastenably joined together with ties 54 or other refastenable fasteners. Similarly, the grass skirt 52 includes an opening in the back that extends at least a partial length of the grass skirt 52 between a first longitudinal edge 28 and a second longitudinal edge 30 of the grass skirt 52. FIG. 11 also shows the grass skirt 52 in FIG. 10 in an unfastened state. Like the bikini top 50, the first longitudinal edge 28 and the second longitudinal edge 30 of the grass skirt 52 can be refastenably joined together with ties 54 or other refastenable fasteners.

The outfit 20 may also include a jacket, such as a blazer, a winter jacket, a windbreaker, a jean jacket, a faux fur coat, as well as a scarf, a cape, or a stole. The outfit 20 may also include sleepwear, such as pajamas or a nightgown, and may include sleep accessories, such as a sleep mask or a teddy bear. The outfit 20 may also include a uniform, or parts of a uniform, such as a military uniform, a scout uniform, or a work-related uniform, such as a lab coat, scrubs, a hazmat suit, or the clothing of a policeman, a fireman, a postal worker, or a dentist.

The refastenable seam 32 may include hook and loop closures, such as Velcro®, snaps, buttons, magnets, a zipper, ties or laces, sticky surfaces, such as silicone or adhesives, or any other suitable refastenable device for attaching and detaching the first and second longitudinal edges 28, 30 to one another. Additionally or alternatively, the outfit 20 may include one or more elasticized elements that span a distance between the first longitudinal edge 28 and the second longitudinal edge 30 when the outfit 20 is worn by the plant 22 or fitted about the planter 24. For example, the outfit 20 may include two, three, or four elasticized elements that are either parallel to one another or that intersect. The elasticized elements may be strands of elastic or strands of rubber, or fabric-covered strands of elastic or rubber, for example. The outfit 20 may also include elasticized portions, in the form of elastic strands or other elasticized material, for example, inserted in one or more locations of the outfit 20 not necessarily between the first and second longitudinal edges 28, 30, in order to provide a more secure, adjustable fit around the plant 22 or planter 24.

According to certain embodiments, the outfit 20 may include an adjustable fastening device 56 that adjusts a width of the opening when the outfit 20 is worn by the plant 22 or fitted about the planter 24. For example, one or more first fastening devices 58 may be located on or near the first longitudinal edge 28 of the outfit 20, either on a surface of the outfit 20 or extending from the edge of the outfit 20. One or more second fastening devices 60, that can be fastened to the one or more first fastening devices 58, may be located on or near the second longitudinal edge 30 of the outfit 20, either on a surface of the outfit 20 or extending from the edge of the outfit 20, or spanning a distance along a width of the outfit 20.

Figure 12:
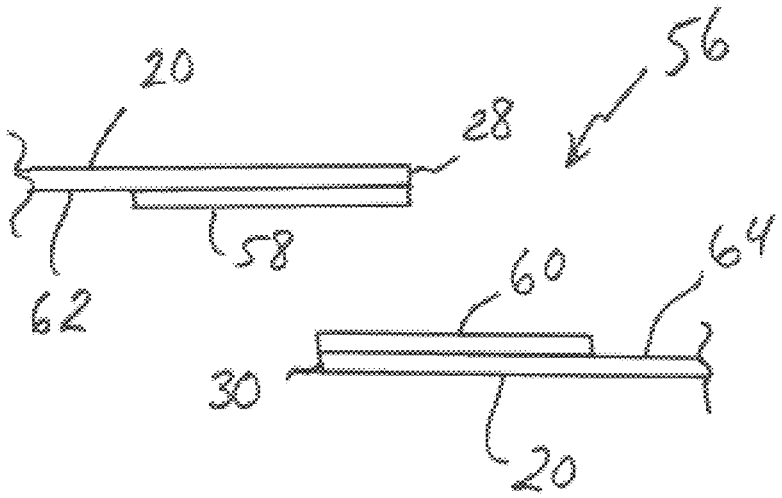
FIG. 12 is cross-sectional view of one embodiment of an adjustable fastening device.

More particularly, FIG. 12 shows a cross-sectional view of one embodiment of an adjustable fastening device 56, which includes a first fastening device 58 in the form of a hook closure of a hook-and-loop fastener, located on an inner surface 62 of the outfit 20 near the first longitudinal edge 28 of the outfit 20, and a second fastening device 60 in the form of a loop closure of a hook-and-loop fastener, located on an outer surface 64 of the outfit 20 near the second longitudinal edge 30 of the outfit 20. The lengths of the individual portions of the hook and loop closures determine the range of adjustability for fitting the outfit 20 around the plant 22 or planter 24.

Figure 13:
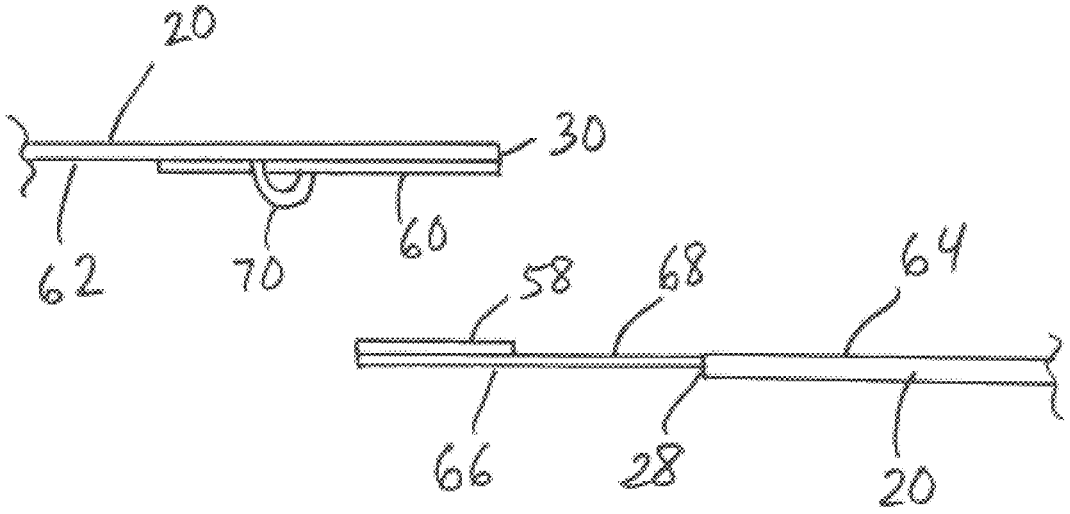
FIG. 13 is a cross-sectional view of another embodiment of an adjustable fastening device.

FIG. 13 shows a cross-sectional view of another embodiment of an adjustable fastening device 56, which includes a first fastening device 58 in the form of a hook closure of a hook-and-loop fastener, located on an outer surface 68 of a strand of elastic 66, with the strand of elastic 66 attached on or near the first longitudinal edge 28 of the outfit 20. A second fastening device 60 in the form of a loop closure of a hook-and-loop fastener is located on an inner surface 62 of the outfit 20 near the second longitudinal edge 30 of the outfit 20. The outfit 20 may also include one or more support loops 70, formed of fabric, plastic, elastic, or other suitable materials, through which the elastic strand 66 with the hook closure may be threaded prior to attaching the hook closure to the loop closure. Additionally, the strand of elastic 66 may have an adjustable length, such as through the inclusion of a ring piece and a slider piece, with the strand of elastic 66 woven through the slider and ring. Alternatively, a non-elasticized strap of material may be used in place of the strand of elastic 66, and the non-elasticized strap may have an adjustable length, such as through the inclusion of a ring piece and a slider piece, with the non-elasticized strap woven through the slider and ring.

In each of the embodiments described herein, the hook closure and the loop closure may be interchanged, switching locations as one sees fit.

Figure 14A:
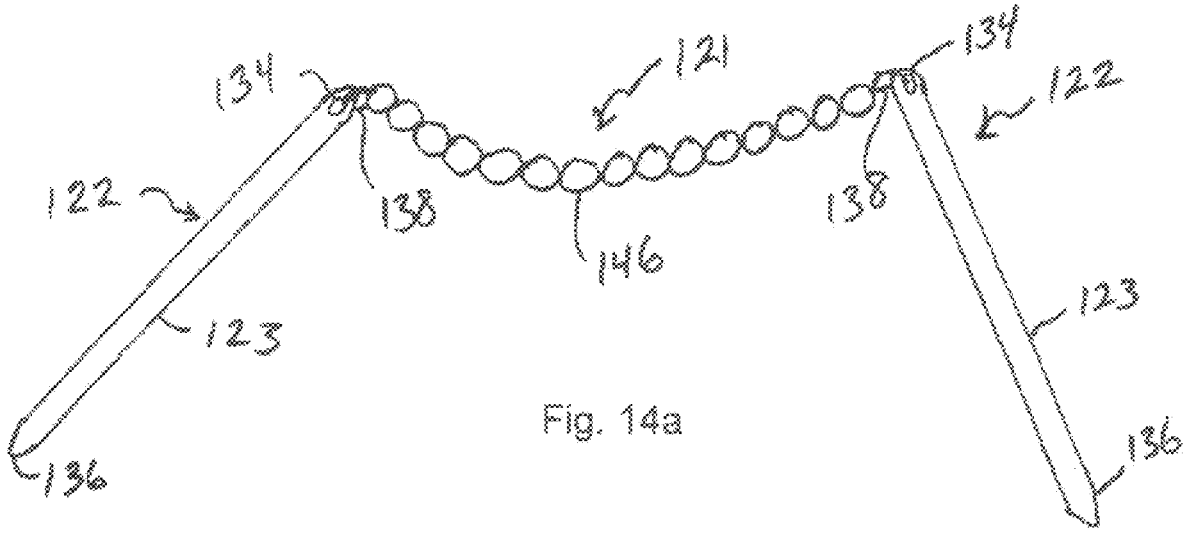
FIG. 14*a* is a perspective view of one embodiment of a fashion accessory in the form of a necklace.
Figure 14B:
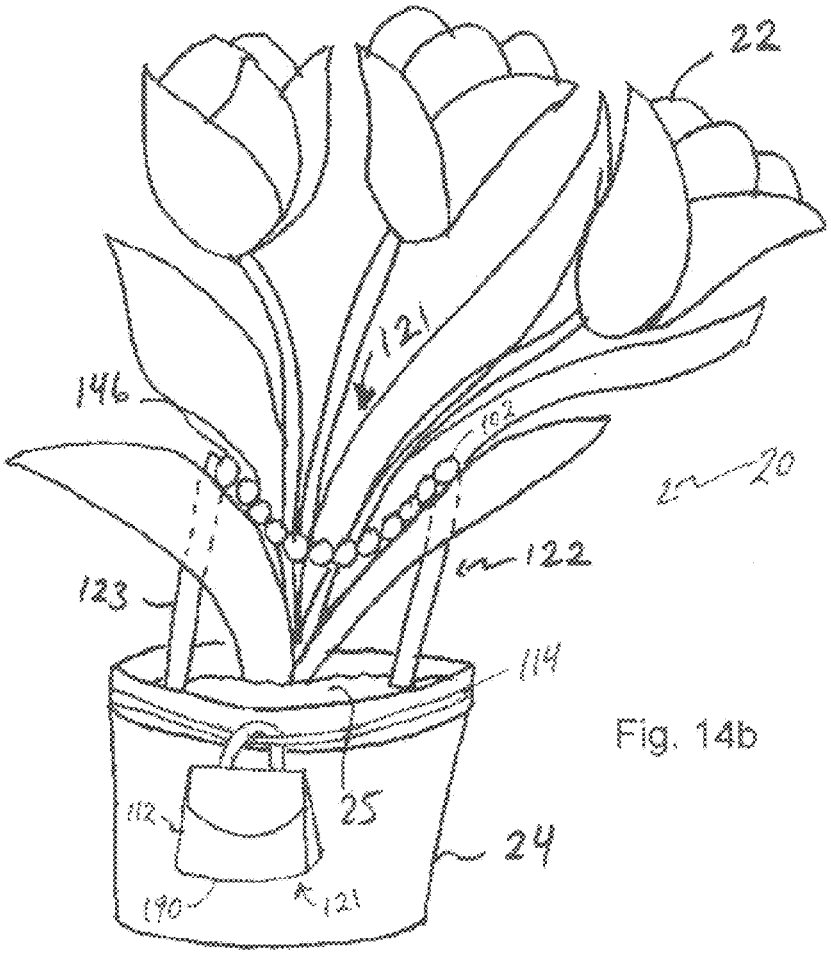
FIG. 14*b* is a front perspective view of the fashion accessory in FIG. 14*a* adorning a plant and a handbag adorning a planter.

According to certain embodiments, particularly with a stick-like, rigid support 123 as illustrated in FIGS. 14*a* and 14*b*, one end 134 of the support 123 may be attached to the fashion accessory 121, such as a necklace 146, and an opposite end 136 of the support 123 may be configured for insertion into a medium 25 in which roots of the plant 22 are situated, such as soil, rocks, or other planting media. The end 134 of the support 123 attached to the fashion accessory 121 may be fixedly or permanently attached to the fashion accessory 121; or the end 134 of the support 123 attached to the fashion accessory 121 may be refastenably attached to the fashion accessory 121, such as with strings or ties or hook-and-loop fasteners, for example. Additionally, an end 138 of the fashion accessory 121 attached to the end 134 of the support 123 may have an adjustable length, such as through the inclusion of a ring piece and a slider piece, with a length of the end of the fashion accessory 121 woven through the slider and ring.

FIG. 14*b* shows the outfit 20 in the form of two fashion accessories 121. The first wearable article 102 is in the form of the necklace 146 shown in FIG. 14*a* adorning a plant 22 and the second wearable article 112 is in the form of a handbag 190 adorning a planter 24. The necklace 146 is attached to the rigid supports 123, which are inserted into the planting medium 25, as described above. The handbag 190 is fitted to the planter 24 with a connector 114 in the form of a ribbon that encircles a circumference of the planter 24. The connector 114 can be tied in a bow or secured to itself with hook and loop fasteners at its ends or secured to the planter 24 with hooks or any other securing devices known to those skilled in the art.

Figure 15A:
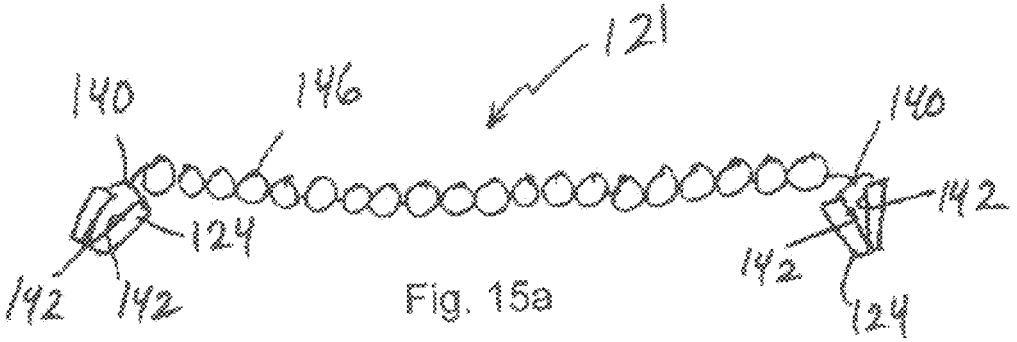
FIG. 15*a* is a perspective view of another embodiment of a fashion accessory in the form of a necklace.
Figure 15B:
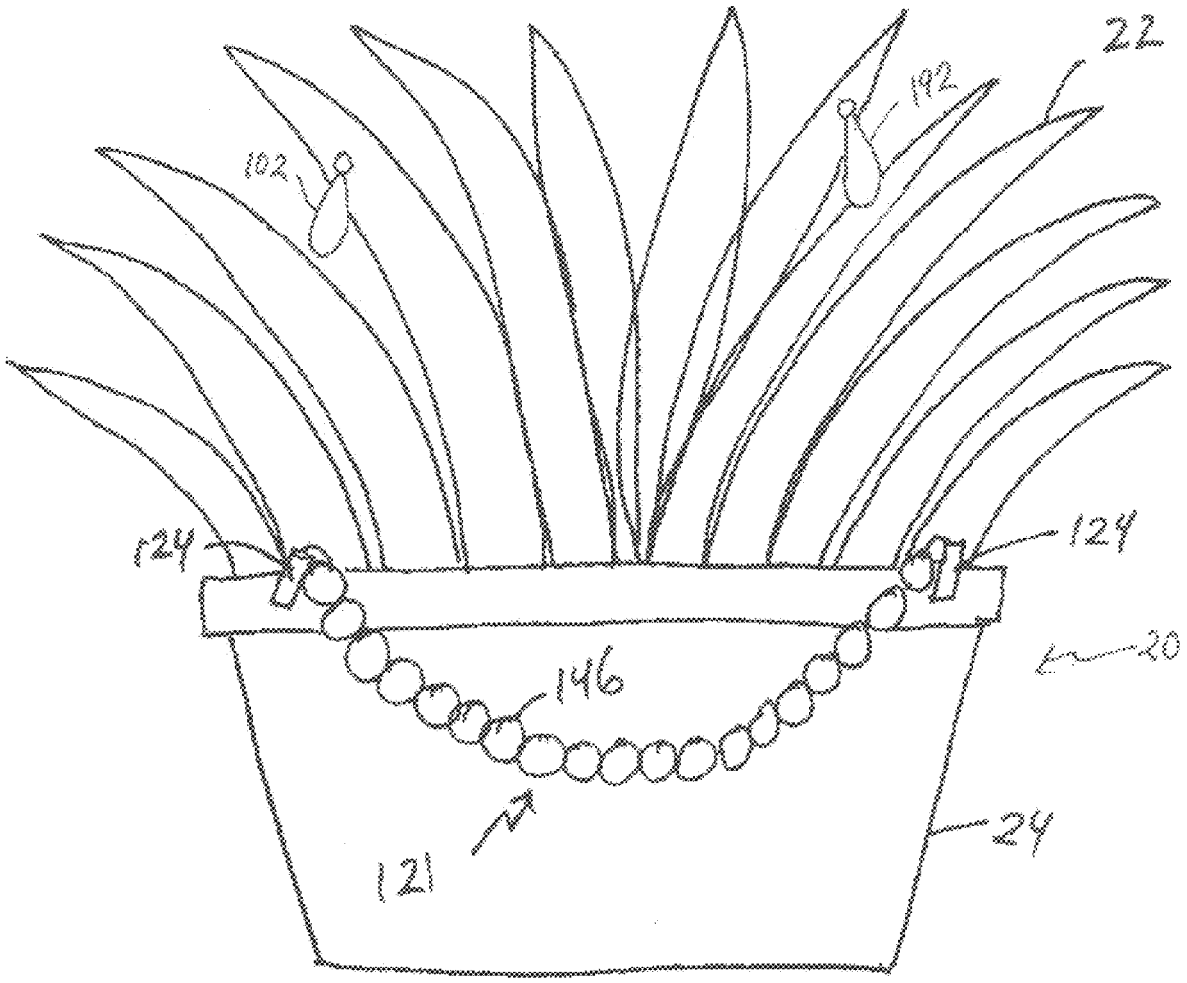
FIG. 15*b* is a front perspective view of the necklace in FIG. 15*a* adorning a planter and another fashion accessory in the form of earrings adorning a plant.

According to certain embodiments, particularly with one or more supports 122 in the form of a clip 124 as illustrated in FIGS. 15*a* and 15*b*, the fashion accessory 121, in this case a necklace 146, may be attached to the planter 24, with the clip 124 support attached to the edge or rim 144 of the planter 24, for example. Alternatively, the fashion accessory 121 may be attached to an outer surface 140 of the clip support 124, and the clip support 124 may be attached to the plant 22 by inserting a leaf or other portion of the plant 22 between two surfaces of the clip support 124. The outer surface 140 of the clip support 124 attached to the fashion accessory 121 may include any of the refastenable materials and devices described above, such as strings or ties or hook-and-loop fasteners, for example. Alternatively, the outer surface 140 of the clip support 124 attached to the fashion accessory 121 may be fixedly or permanently attached to the fashion accessory 121, such as with adhesive, welding, or mechanical fastening, such as tied with plastic, metal, or fabric fasteners.

Figure 15C:
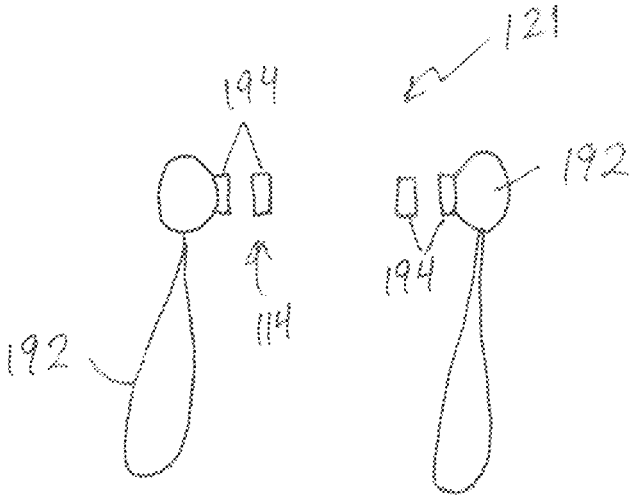
FIG. 15*c* is a plan view of the earrings in FIG. 15*b*.

Like FIG. 14*b*, FIG. 15*b* also shows the outfit 20 in the form of two fashion accessories 121. The first wearable article 102 is in the form of a pair of earrings 192 worn by a plant 22 and the second wearable article 112 is in the form of the necklace 146 fitted to a planter 24, as described above. The earrings 192 are attached to leaves of the plant 22 with connectors 114 in the form of magnets 194. FIG. 15*c* shows the earrings 192 in an unattached state. Each earring 192 has a magnet 194 secured to a back side of the earring 192, such as with an adhesive or other permanent bonding. A corresponding magnet 194 having opposite polarity can be attached to the bonded magnet 194. A leaf or other portion of the plant 22 can be inserted between the magnets 194 of opposite polarity in order to secure the earring 192 to the plant 22. Additionally or alternatively, the earrings 192 may be secured to the plant 22 with any of the other aforementioned connectors 114, such as bendable wires, ribbon, adhesive, and the like.

According to still other embodiments, the fashion accessory 121 may be configured to be fitted to at least a portion of the planter 24. The fashion accessory 120 may be attached to the planter 24 either permanently, such as with adhesive, welding, or mechanical fastening, such as tied with plastic, metal, or fabric fasteners; or the fashion accessory 121 may be refastenably attached to the planter 24 or to a corresponding surface of the fashion accessory 121 itself, such as with any of the refastenable materials and devices described above.

The fashion accessory 121 that may be applied to either the plant 22 or the planter 24, or to a plant hanger, may be virtually any type of fashion accessory. For example, the fashion accessory 121 may be jewelry, such as the necklace 146 shown in FIGS. 14*a*, 14*b*, 15*a*, and 15*b*. Alternatively, jewelry may include a brooch, a ring, an ear cuff, a tiara, earrings, or any other suitable type of jewelry.

Figure 16A:
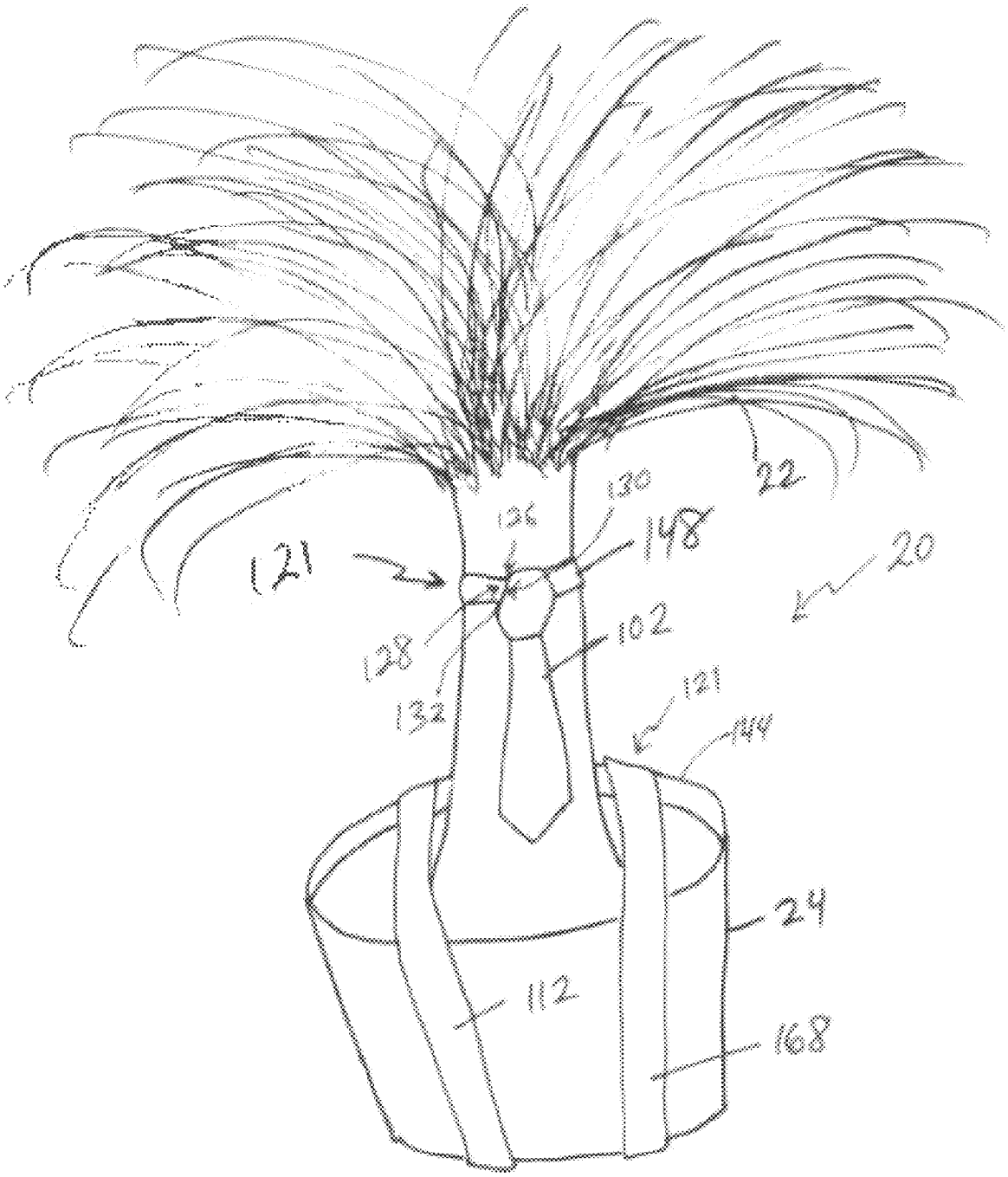
FIG. 16*a* is a front perspective view of another embodiment of an outfit in the form of a necktie adorning a plant and suspenders adorning a planter.
Figure 17:
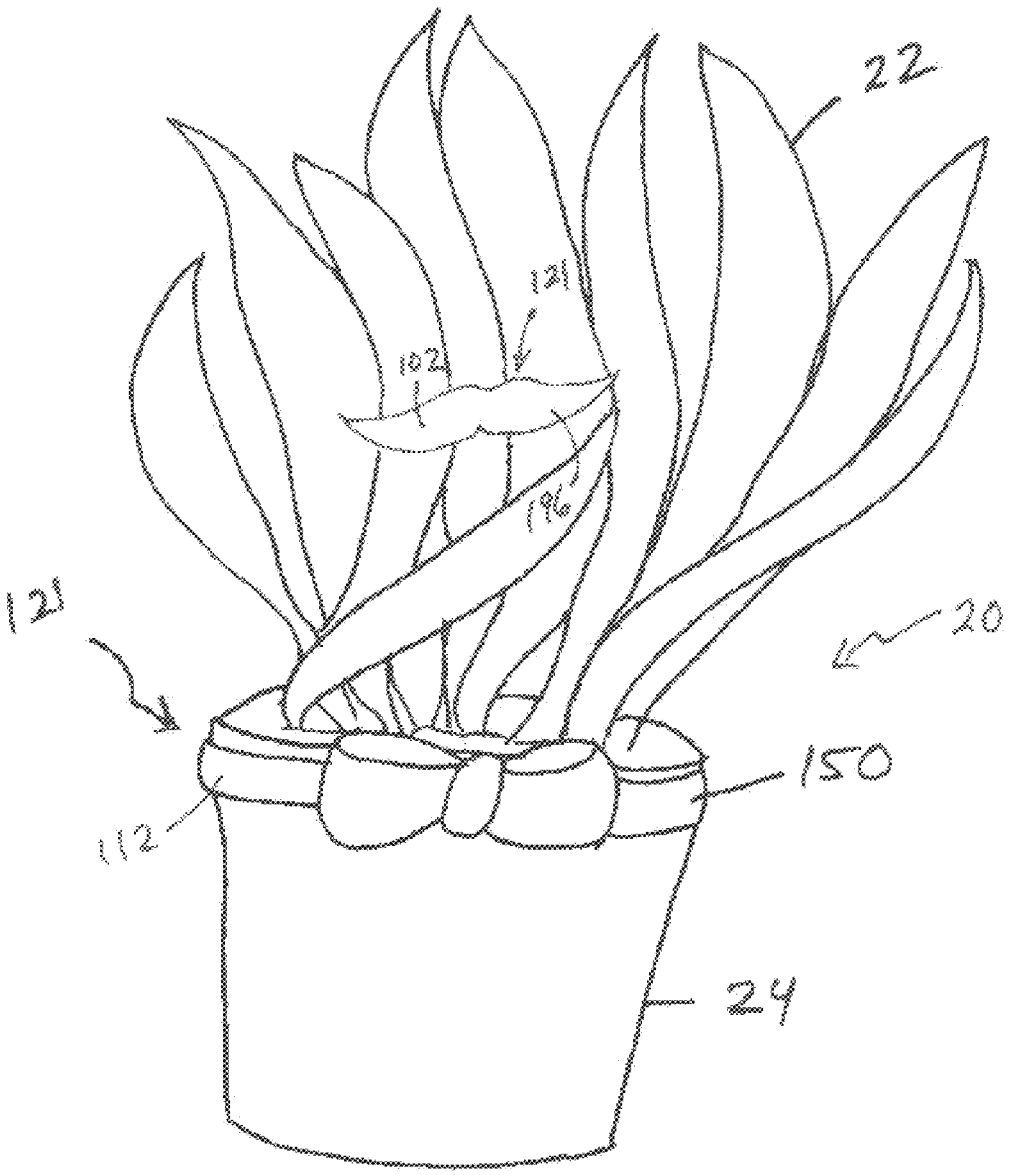
FIG. 17 is a front perspective view of another embodiment of an outfit in the form of a mustache adorning a plant and a bowtie adorning a planter.

As another example, the fashion accessory 121 may be a tie, such as either a necktie 148 or a bowtie 150, as shown in FIGS. 16*a* and 17. The necktie 148 and bowtie 150 shown in FIGS. 16*a* and 17 can be attached to the plant 22 and planter 24, respectively, using an adjustable fastening device 56, such as those illustrated in FIGS. 12 and 13, for example. The adjustable fastening device 56 applied to the fashion accessory 121 may also include one or more elasticized elements and/or adjustable straps, as described herein.

Figure 16B:
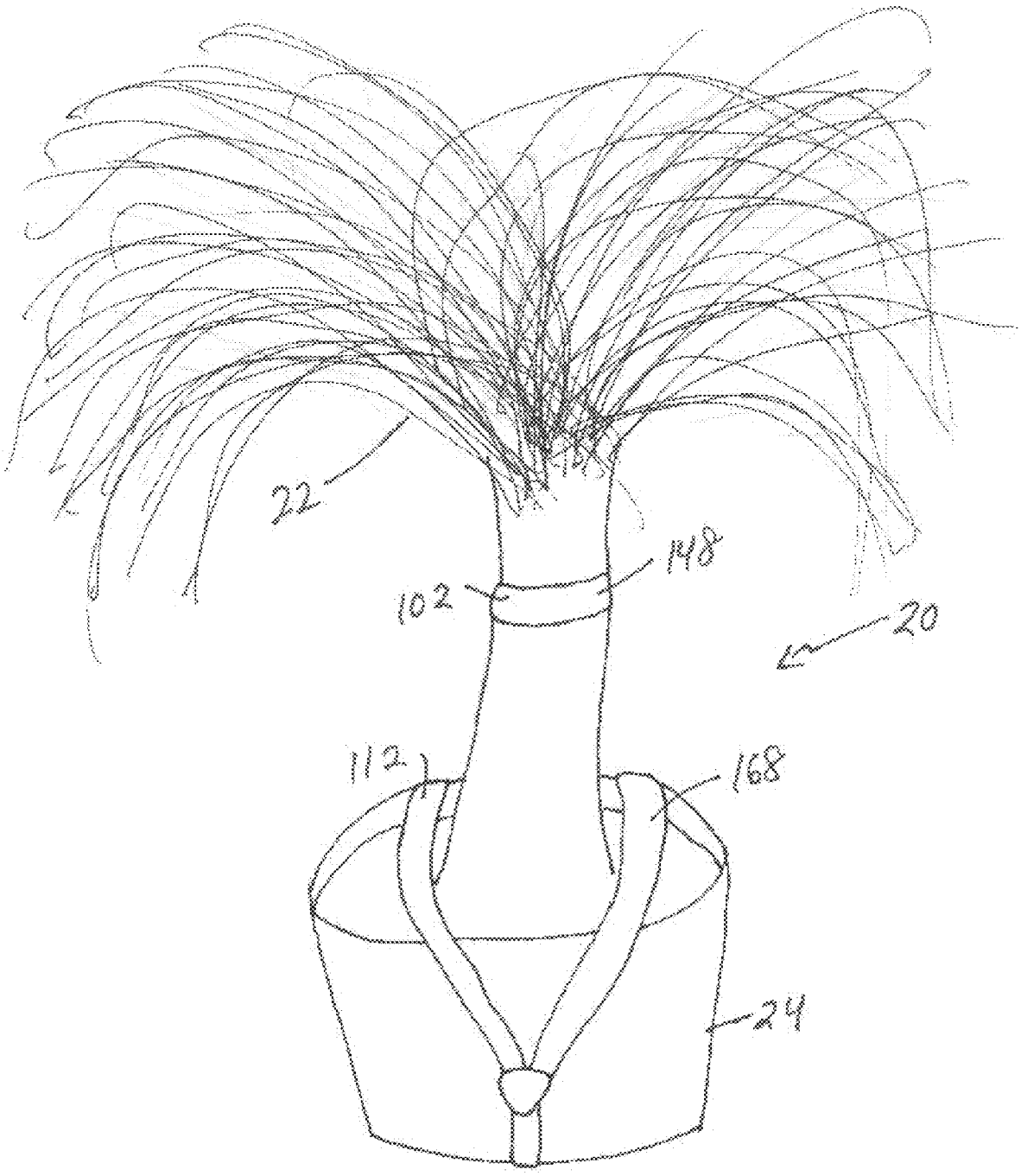
FIG. 16*b* is a rear perspective view of the outfit in FIG. 16*a*.

FIG. 16*a* shows the outfit 20 in the form of two fashion accessories 121. The first wearable article 102 is in the form of the necktie 148 described above adorning a plant 22 and the second wearable article 112 is in the form of suspenders 168 fitted to a planter 24. The suspenders 168 are fitted to the planter 24 by virtue of the elasticity within the suspenders 168. In the embodiment shown in FIGS. 16*a* and 16*b*, the suspenders extend fully above and below the planter 24, such that a bottom surface of the planter 24 rests on the suspenders, thereby providing an additional benefit of serving as a coaster on the surface upon which the planter 24 rests, similar to the diaper shown in FIG. 6. Additionally or alternatively, the suspenders 168 may be secured to the planter 24 with any of the other aforementioned connectors 114.

FIG. 17 also shows the outfit 20 in the form of two fashion accessories 121. The first wearable article 102 is in the form of a mustache 196 worn by the plant 22 and the second wearable article 112 is in the form of the bowtie 150 described above fitted to a planter 24. The mustache 196 shown in FIG. 17 is fitted to the plant 22 with an adhesive, such as school glue or double-sided tape or rubber cement. Additionally or alternatively, the mustache 196 may be secured to the plant 22 with any of the other aforementioned connectors 114, such as using one or more rigid supports 123.

Figure 18A:
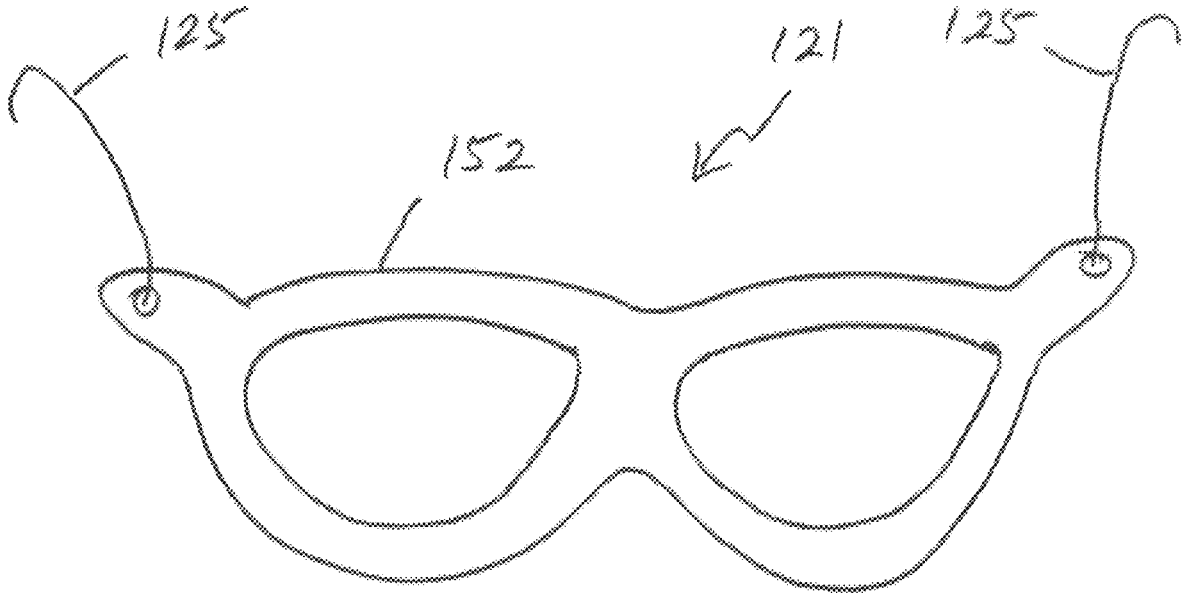
FIG. 18*a* is a perspective view of yet another embodiment of a fashion accessory in the form of eyeglasses.
Figure 18B:
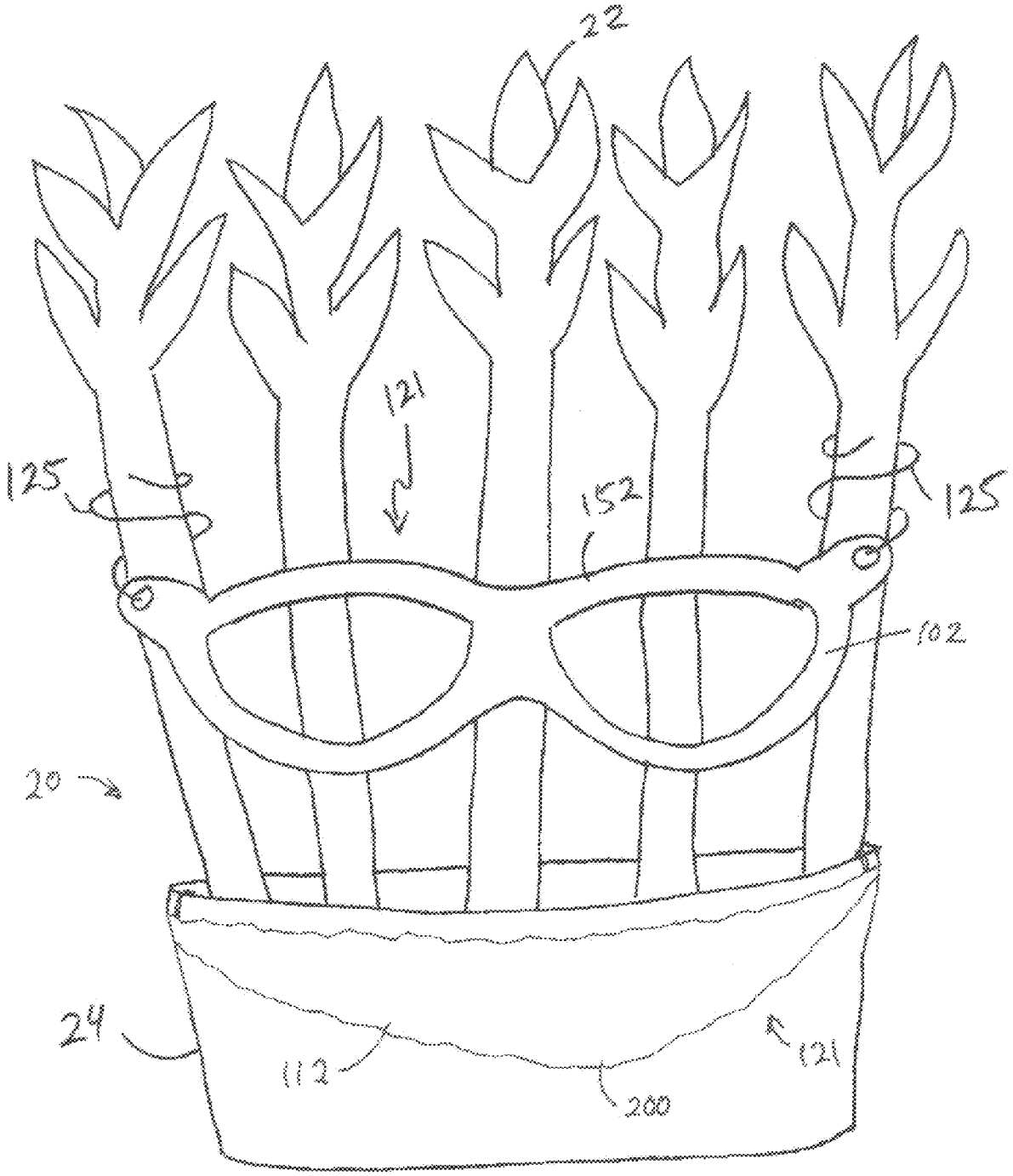
FIG. 18*b* is a front perspective view of the eyeglasses in FIG. 18*a* adorning a plant and a beard adorning a planter.
Figure 18C:
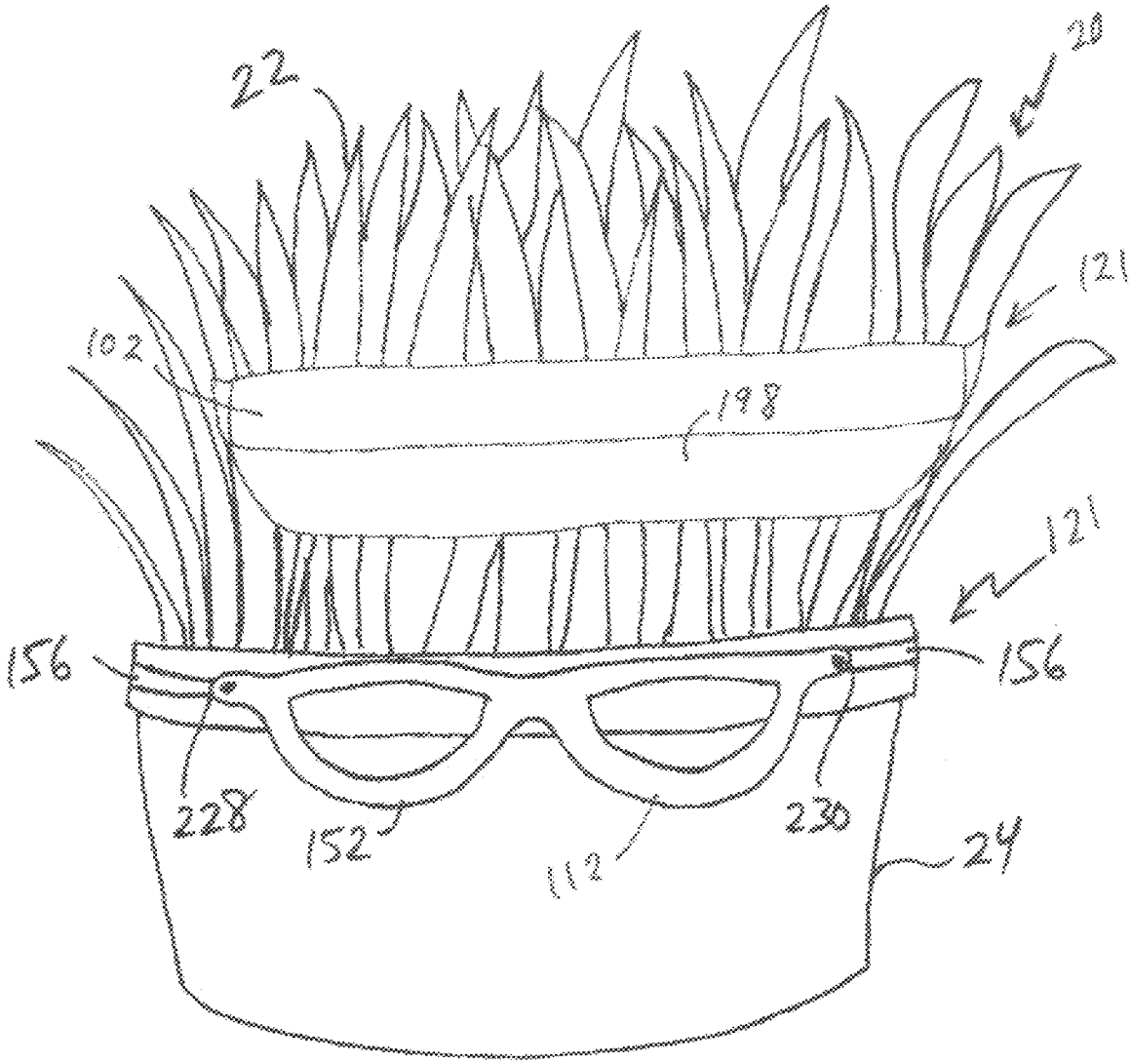
FIG. 18*c* is a front perspective view of another embodiment of a fashion accessory in the form of eyeglasses adorning a planter and a visor adorning a plant.

The fashion accessory 121 may also be eyeglasses 152, such as vision eyeglasses, fashion eyeglasses, or sunglasses, as shown in FIGS. 18*a*, 18*b*, and 18*c*. The eyeglasses 152 may include bendable supports 125, as shown in FIG. 18*a*. One end of each support 125 may be attached to the eyeglasses 152 and an opposite end of each support 125 can be wrapped one or more times around one or more branches, stems, or leaves to secure the fashion accessory 121 to the plant 22, as shown in FIG. 18*b*. Alternatively, the fashion accessory 121 may include one or more elasticized elements 156 that span a distance between a first longitudinal edge 228 of the eyeglasses 152 and a second longitudinal edge 230 of the eyeglasses 152 when the fashion accessory 121 is either worn by a plant 22 or when fitted about the planter 24, as shown in FIG. 18*c*. The elasticized elements 156 may be strands of elastic or strands of rubber, or fabric-covered strands of elastic or rubber, for example.

FIG. 18*b* shows the outfit 20 in the form of two fashion accessories 121. The first wearable article 102 is in the form of the eyeglasses 152 described above worn by the plant 22 and the second wearable article 112 is in the form of a beard 200 fitted to a planter 24. The beard 200 shown in FIG. 18*b* may be made of fake fur or any sort of hair-like material, such as a costume beard available for human wear. The beard 200 is fitted to the planter 24 with either an elasticized back strap or an adhesive coating, just like a costume beard worn by humans. Additionally or alternatively, the beard 200 may be secured to the planter 24 with any of the other aforementioned connectors 114.

FIG. 18*c* shows the outfit 20 in the form of two fashion accessories 121. The first wearable article 102 is in the form of a sun visor 198 worn by the plant 22 and the second wearable article 112 is in the form of the eyeglasses 152 described above fitted to a planter 24. The sun visor 198 shown in FIG. 18*b* is fitted to the plant 22 with either an elasticized back strap or a refastenable strap in the back of the sun visor 198, just like a conventional sun visor worn by humans. Additionally or alternatively, the sun visor 198 may be secured to the plant 22 with any of the other aforementioned connectors 114, such as using one or more rigid supports 123.

Other suitable fashion accessories 121 that can be adorned by plants 22 and/or planters 24, as described herein, include: a hat and/or bow; earmuffs, earbuds, or headphones; a bib; a cape; a mask or sleep mask; a scarf; a stole; shoes or other footwear; mittens; gloves; artificial hands; a book; a handbag; a backpack; a briefcase; a tote bag; a fanny pack; a belt or collar; a holiday decoration, such as Christmas, Easter, Valentine's Day, Halloween, Fourth of July, Mardi Gras, St. Patrick's Day, New Year's, or Thanksgiving decorations, for example, Christmas lights, bunny ears, jewelry featuring hearts; a musical instrument, such as a viola, cello, violin, guitar, banjo, bagpipes, trumpet, trombone, clarinet, saxophone, flute, or accordion; an umbrella; a tool, such as a hammer, wrench, screwdriver, or drill; facial hair, such as a faux fur beard and/or mustache; a wig or other hair piece, alone and/or with hair accessories, such as a brush, barrettes, scrunchies; an electronic device, such as a cellphone or a laptop; a disco ball; a dining utensil, such as a fork, spoon, knife, or mug; sporting equipment, such as a ball, racket, surfboard, skis, bat, or helmet; other hobby equipment, such as art or sewing supplies; a stuffed animal; a faux food or drink item, such as a burger, taco, banana, soda bottle, wine bottle, or wine glass; ethnic dress garb, such as a French beret, a Viking horned helmet, a Scottish kilt, or a Hawaiian lei; or a faux animal body part, such as an animal tail, wings, a snout, animal ears, animal horn, or an animal trunk.

Certain fashion accessories 121 that include storage spaces, such as a handbag, a backpack, a briefcase, a tote bag, or a fanny pack, can be used to store plant accessories, such as plant food or fertilizer; or to house music playing devices, such as a radio or speaker or other sound maker; or to house fragrance, such as an air freshener; or to house one or more lights.

Figure 19:
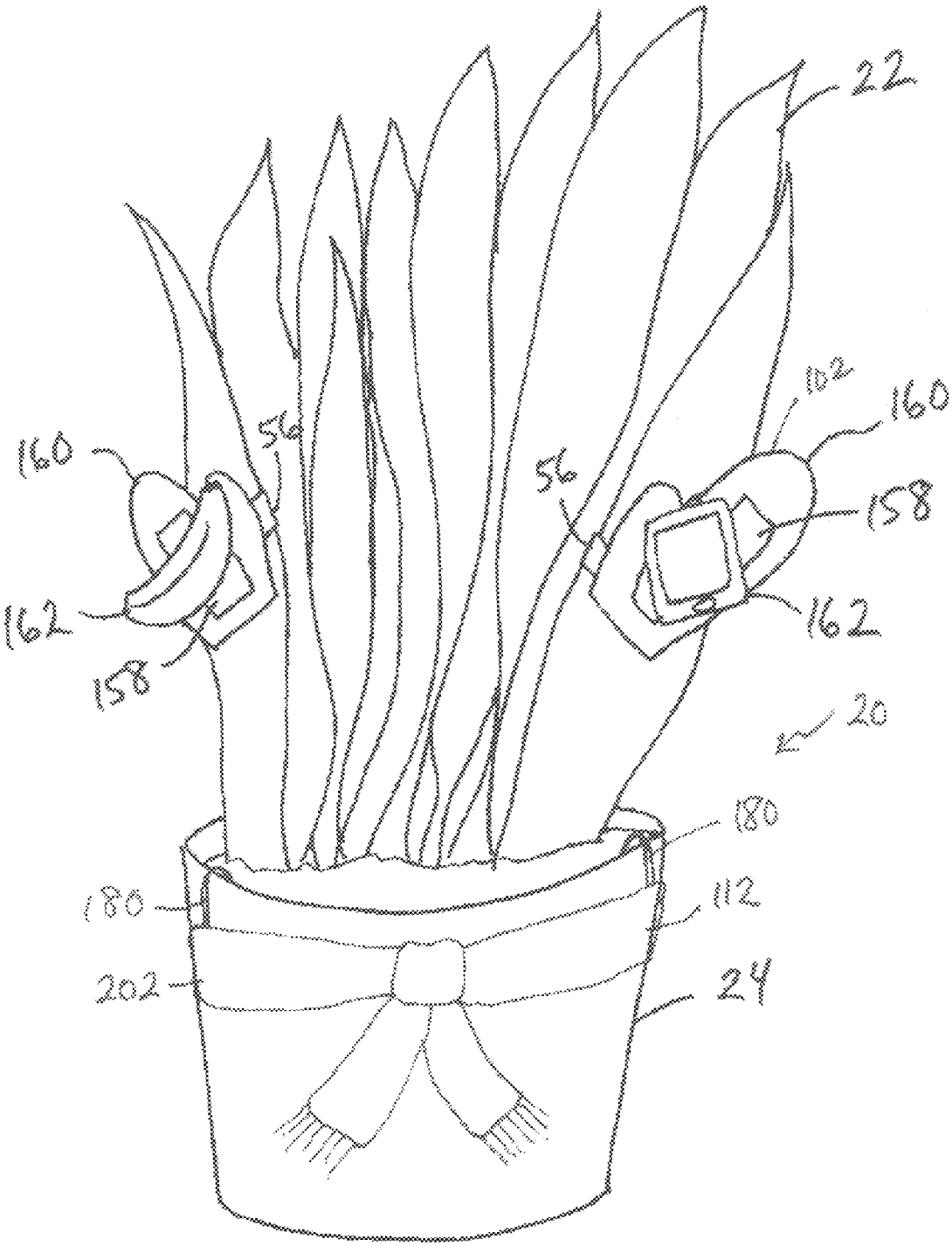
FIG. 19 is a front perspective view of yet another embodiment of an outfit in the form of a pair of mittens adorning a plant and having a refastenable holding surface and a scarf adorning a planter.

FIG. 19 shows the outfit 20 in the form of two fashion accessories 121. The first wearable article 102 is in the form of a pair of mittens 160 worn by the plant 22 and the second wearable article 112 is in the form of a scarf 202 fitted to a planter 24. The mittens 160 shown in FIG. 19 are each fitted to the plant 22 with either an elasticized strap or a refastenable strap. Additionally or alternatively, the mittens 160 may be secured to the plant 22 with any of the other aforementioned connectors 114. The scarf 202 shown in FIG. 19 is fitted to the planter 24 with hooks 180, which may be made of metal, plastic, or other suitable materials. One end of each hook 180 may be sewed, glued, or otherwise secured to the scarf 202 while the opposite end of each hook 180 hooks onto the planter 24. Additionally or alternatively, the scarf 202 may be secured to the planter 24 with any of the other aforementioned connectors 114.

According to certain embodiments, a first wearable article 102 and/or a second wearable article 112 that is a fashion accessory 121 may include one or more refastenable holding surfaces 158. For example, fashion accessories 121 such as mittens, gloves, or artificial hands, or even a generic, non-specifically shaped, holding surface, may be affixed to a plant 22 or planter 24 and provided with a hook or loop fastener surface, or other refastenable surface that can be used to hold decorative or utilitarian features that are affixed with a corresponding loop or hook fastener or other refastenable fastening device. For example, any of the fashion accessories 121 listed above may be refastenably attached to the refastenable holding surface 158 as an additional fashion accessory 121. When desired, the additional fashion accessory 121 may be swapped out for a different additional fashion accessory 121. The refastenable holding surfaces 158 are not limited to hook-and-loop fasteners, but may also include sticky surfaces such as silicone or adhesive-covered surfaces, surfaces that adhere to one another through enhanced friction, magnets, snaps, buttons, ties or laces, or any other suitable refastenable device for attaching and detaching the decorative or utilitarian features to the holding surfaces 158. For example, as shown in FIG. 19, a first fashion accessory in the form of a mitten 160 may be affixed to a plant 22, such as with an adjustable fastening device 56 as illustrated in FIGS. 12 and 13. A fashion second accessory 162, such as a banana or a cellphone, may be refastenably attached to the first fashion accessory. When it is desired to replace the banana or cellphone with another accessory, the cellphone may be removed and easily replaced with a different second fashion accessory 162.

Figure 20:
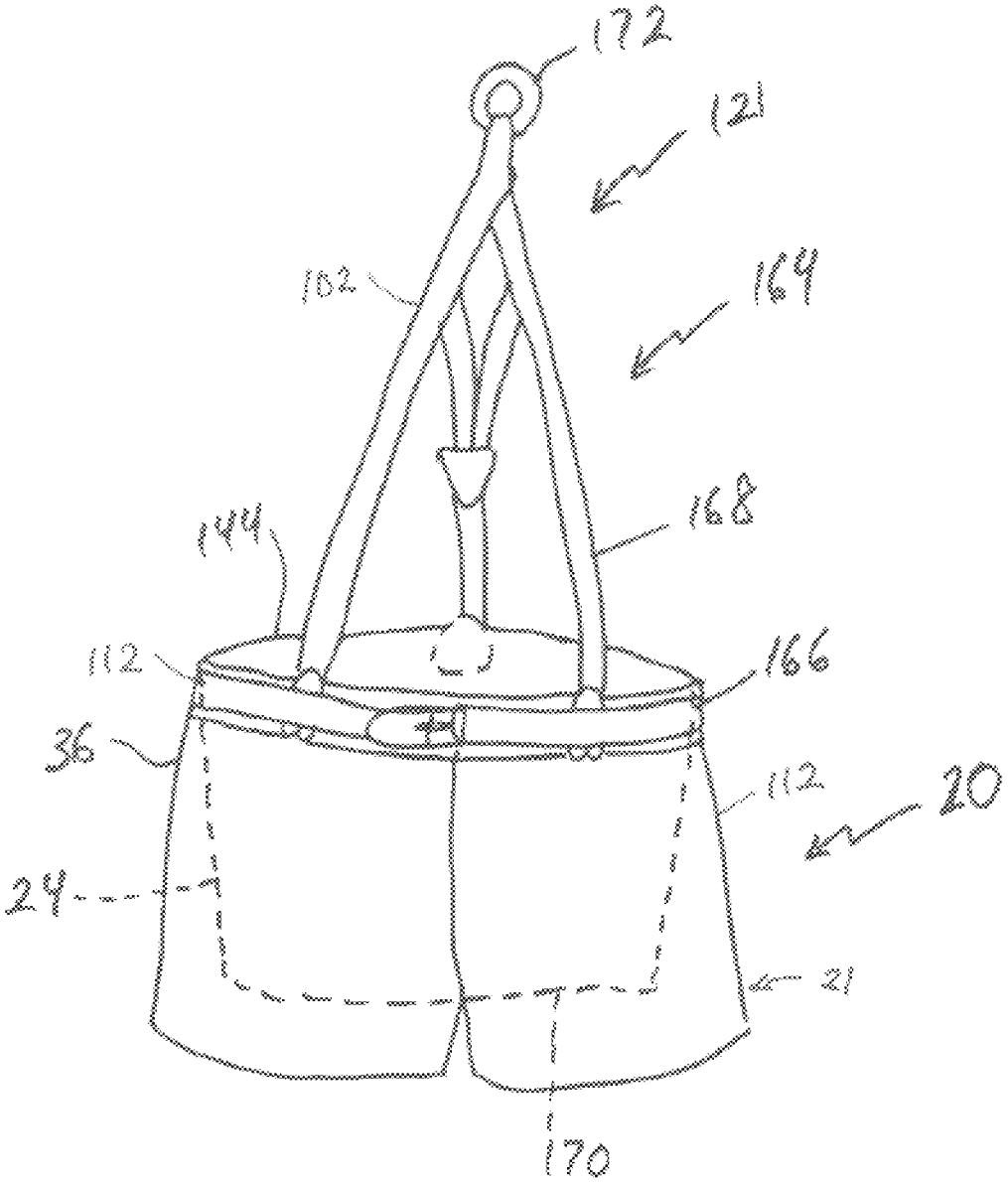
FIG. 20 is a front perspective view of one embodiment of an outfit forming a plant hanger with suspenders configured to adorn a plant and pants adorning a planter.

The fashion accessory 121 may also form a plant hanger 164, which can be used to suspend the planter 24 from a ceiling or hook, thereby keeping a bottom 170 of the planter 24 off of the ground or other surface. The fashion accessory 121 may be paired with either an article of clothing 21 or another fashion accessory 121 for the plant 22 or planter 24. For example, as shown in FIG. 20, the first wearable article 102 is in the form of suspenders 168 worn by the plant 22 and the second wearable article 112 is in the form of either a belt 166 or a pair of pants 36, or both a belt 166 and a pair of pants 36 fitted to a planter 24. As shown by the combination of the suspenders 168 with the belt 166 and/or pants 36, the first wearable article 102 and the second wearable article 112 can be connected to one another either permanently or refastenably. The first wearable article 102 and the second wearable article 112 can be connected to one another using any of the connectors 104, 114 described herein.

When the first wearable article 102 and the second wearable article 112 together form a plant hanger 164, the second wearable article 112 suitably extends below at least a top edge 144 of the planter 24, or below a bottom surface 170 of the planter 24, and can be removably connected to the planter 24, either through a mechanical fit with the planter 24 or through a refastenable connection, such as with any of the refastenable materials and devices described above. The plant hanger 164 may also include a loop 172 or other support structure for attaching the plant hanger 164 to a corresponding hook.

The clothing and/or accessories described herein may also include matching clothing and/or accessories to be worn by humans and/or by pets, such as dogs or cats. More particularly, the outfit 20 may include an additional first wearable article that has the same visual appearance as the first wearable article 102, wherein the additional first wearable article is configured to be worn by a human or by a pet. Additionally or alternatively, the outfit 20 may include an additional second wearable article that has the same visual appearance as the second wearable article 112, wherein the additional second wearable article is configured to be worn by a human or by a pet. Likewise, the outfit 20 may include an additional fashion accessory that has the same visual appearance as the fashion accessory 121, wherein the additional fashion accessory is configured to be worn by a human or by a pet.

While the clothing and accessories described herein are designed to avoid harming the plant's health and growth, the clothing and accessories are not limited to use on living houseplants. The clothing and accessories may be applied to either living plants or artificial plants, such as silk or plastic plants. According to certain embodiments, the clothing and/or accessories may be formed of translucent or transparent material, to allow natural light to pass through the clothing and/or accessories. Furthermore, the clothing and accessories may be applied to either indoor plants or outdoor plants. Examples of suitable types of plants to which the clothing and accessories may be applied include houseplants, such as palm plants, ferns, philodendrons, orchids, money tree plants, fiddle leaf figs, snake plants, spider plants, hoya heart plants, monstera, *Schefflera*, calathea, air plants, cacti and other succulents, birds of paradise, bonsai, lucky bamboo, aloe vera, ZZ plants, olive trees, lime trees, lemon trees, orange trees; herb plants, such as rosemary plants, oregano, thyme, lavender, basil, parsley; flowering plants, such as lilies, tulips, daffodils, paperwhites, crocuses, roses, amaryllis, daisies, hydrangeas, irises; and various other plants that can be grown indoors or outdoors.

The descriptions and figures included herein depict specific implementations to teach those skilled in the art how to make and use the best option. For the purpose of teaching inventive principles, some conventional aspects have been simplified or omitted. Those skilled in the art will appreciate variations from these implementations that fall within the scope of the invention. Those skilled in the art will also appreciate that the features described above can be combined in various ways to form multiple implementations. As a result, the invention is not limited to the specific implementations described above, but only by the claims and their equivalents.

What is claimed is:

1. A decorative system, comprising:

a plant;

a planter housing the plant;

a medium holding the plant in place within the planter;

at least one support, the at least one support having a first end and a second end opposite the first end;

a garment configured to be worn by the plant and configured to be fitted to at least a portion of the planter, wherein the garment comprises:

a first wearable article that is configured to be worn by at least one branch, stem, and/or leaf of the plant, and the first wearable article is attached to the first end of the at least one support, and the second end of the at least one support is configured for insertion into the medium in the planter in which roots of the plant are situated, and a second wearable article that is configured to be fitted to at least a portion of the planter in which the plant is planted, and the second wearable article extends below the planter and covers a bottom surface of the planter, serving as a barrier against water damage, wherein at least one of the first and the second wearable articles comprises a refastenable attachment element for attaching at least one fashion accessory to the at least one of the first and the second wearable articles.

2. The decorative system according to claim 1, wherein the first wearable article is an article of clothing.

3. The decorative system according to claim 1, wherein the first wearable article is a fashion accessory.

4. The decorative system according to claim 1, wherein the second wearable article is an article of clothing.

5. The decorative system according to claim 1, wherein the second wearable article is a fashion accessory.

6. The decorative system according to claim 1, wherein the first wearable article is selected from the group consisting of: a shirt, a dress, a sweater, a jacket, swimwear, sleepwear, a bib, a cape, a scarf, a stole, a uniform, a costume, a hat, a tiara, earmuffs, suspenders, a necklace, earrings, a bowtie, a necktie, eyeglasses, sunglasses, mittens, gloves, a handbag, a backpack, a briefcase, a tote bag, a fanny pack, a belt, a holiday decoration, a musical instrument, an umbrella, a tool, facial hair, a wig, an electronic device, a dining utensil, a pacifier, sporting equipment, a stuffed animal, a faux food item, and faux animal body parts.

7. The decorative system according to claim 1, wherein the second wearable article is selected from the group consisting of: pants, shorts, a dress, a skirt, a shirt, a sweater, a jacket, swimwear, sleepwear, a diaper, a cape, a scarf, a stole, a uniform, a costume, an apron, suspenders, a necktie, a holiday decoration, a musical instrument, a tool, at least one shoe, at least one sock, sporting equipment, a faux food item, and faux animal body parts.

8. The decorative system according to claim 1, wherein the first wearable article and the second wearable article are connected to one another.

9. The decorative system according to claim 1, wherein the second wearable article is configured to be fitted to the at least a portion of the planter with at least one connector selected from the group consisting of: elasticized material, hooks, hook and loop fasteners, snaps, buttons, bendable wires, flexible supports, stick-like rigid supports, ribbon, string, a zipper, an adjustable strap, a buckle, a slider and ring, and magnets.

10. The decorative system according to claim 1, wherein the at least one fashion accessory is selected from the group consisting of: a necklace, earrings, a bowtie, a necktie, eyeglasses, sunglasses, a hat, a bib, a cape, a scarf, a stole, mittens, gloves, a handbag, a backpack, a briefcase, a tote bag, a fanny pack, a belt, a holiday decoration, a musical instrument, an umbrella, a tool, facial hair, a wig, an electronic device, a dining utensil, sporting equipment, a stuffed animal, a faux food item, and faux animal body parts.

11. The decorative system according to claim 1, wherein the at least one fashion accessory includes a storage space.

12. The decorative system according to claim 1, further comprising an additional first wearable article that has the same visual appearance as the first wearable article, wherein the additional first wearable article is configured to be worn by a human or by a pet.

13. The decorative system according to claim 1, further comprising an additional second wearable article that has the same visual appearance as the second wearable article, wherein the additional second wearable article is configured to be worn by a human or by a pet.

14. The decorative system according to claim 1, further comprising an additional fashion accessory that has the same visual appearance as the at least one fashion accessory, wherein the additional fashion accessory is configured to be worn by a human or by a pet.

15. A decorative system, comprising:

a plant;

a planter housing the plant;

a medium holding the plant in place within the planter;

a garment configured to be worn by the plant and configured to be fitted to at least a portion of the planter, wherein the garment comprises a first wearable article that is configured to be attached to one or more branches, stems, or leaves of the plant with at least one support having at least one connector selected from the group consisting of: bendable wires, flexible supports, stick-like rigid supports, ribbon, string, elasticized material, hook and loop fasteners, snaps, buttons, a zipper, a silicone surface, an adhesive-covered surface, a surface having enhanced friction, and magnets, wherein the at least one support includes a first end attached to the first wearable article and a second end that can be wrapped one or more times around the one or more branches, stems, or leaves; and a second wearable article that is configured to be fitted to the at least a portion of the planter with at least one connector selected from the group consisting of: elasticized material, hook and loop fasteners, snaps, buttons, bendable wires, flexible supports, stick-like rigid supports, ribbon, string, a zipper, magnets, hook and loop fasteners, snaps, a silicone surface, an adhesive-covered surface, a surface having enhanced friction, and buttons, wherein the second wearable article extends below the planter and covers a bottom surface of the planter, serving as a barrier against water damage, and wherein at least one of the first and the second wearable articles comprises a refastenable attachment element for attaching at least one fashion accessory to the at least one of the first and the second wearable articles.

* * * * *